US006213226B1

(12) United States Patent
Eppink et al.

(10) Patent No.: US 6,213,226 B1
(45) Date of Patent: Apr. 10, 2001

(54) DIRECTIONAL DRILLING ASSEMBLY AND METHOD

(75) Inventors: Jay M. Eppink, Spring; David E. Rios-Aleman, Houston; Albert C. Odell, Kingwood, all of TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 08/984,846

(22) Filed: Dec. 4, 1997

(51) Int. Cl.[7] ..... E21B 7/06
(52) U.S. Cl. ..... 175/61; 175/73; 175/76
(58) Field of Search ..... 175/61, 73, 76, 175/325.1, 385, 391

(56) References Cited

U.S. PATENT DOCUMENTS

| | | | | |
|---|---|---|---|---|
| 3,129,776 | * | 4/1964 | Mann | 175/76 |
| 3,753,470 | | 8/1973 | Lagerstrom et al. | 175/292 |
| 4,040,494 | | 8/1977 | Kellner | 175/45 |
| 4,076,084 | | 2/1978 | Tighe | 175/73 |
| 4,319,649 | | 3/1982 | Jeter | 175/73 |
| 4,388,974 | | 6/1983 | Jones, Jr. et al. | 175/325.2 |

(List continued on next page.)

OTHER PUBLICATIONS

Andergauge Drilling Systems—Simplicity in Action; How to Drill Horizontal Sections Faster; World Oil; Dec. 1991; (6 p.).
Diamond Products International; *The Latest Generation of Bi–Center Bits;* Speed Reamer™; (undated).
3D Stabilisers; *Steerable Stabiliser;* (10 p.); Undated.
Drilco Drilling Handbook.; Bottom Hole Assemblies; (pp 4–28); Undated.
Pilot Drilling Control Ltd.; *Variable Gauge Stabilizer;* (4 p.); undated.
Eastman Christensen; *Vertical Drilling System (VDS);* (39 p.); (undated).
Andergauge Drilling Systems; *Bil Center Stabilizer;* Feb. 14, 1997; (10 p.).
Diamond Products International; A Bit of Excellence; Reprinted from 42$^{nd}$ (1996–97) Composite Catalog®; (41 p.); 1996–97.
The American Oil & Gas Reporter; Advances in Bits Give Operators Fresh Look at Maximizing Performance and Cutting Costs; Apr. 1996; (5 p.).

(List continued on next page.)

*Primary Examiner*—Hoang Dang
(74) *Attorney, Agent, or Firm*—Conley, Rose & Tayon, P.C.

(57) ABSTRACT

The drilling assembly includes an eccentric adjustable diameter blade stabilizer having a housing with a fixed stabilizer blade and a pair of adjustable stabilizer blades. The adjustable stabilizer blades are housed within openings in the stabilizer housing and have inclined surfaces which engage ramps on the housing for camming the blades radially upon their movement axially. The adjustable blades are operatively connected to an extender piston on one end for extending the blades and a return spring at the other end for contracting the blades. The eccentric stabilizer also includes one or more flow tubes through which drilling fluids pass that apply a differential pressure across the stabilizer housing to actuate the extender pistons to move the adjustable stabilizer blades axially upstream to their extended position. The eccentric stabilizer is mounted on a bi-center bit which has an eccentric reamer section and a pilot bit. In the contracted position, the areas of contact between the eccentric stabilizer and the borehole form a contact axis which is coincident with the pass through axis of the bi-center bit as the drilling assembly passes through the existing cased borehole. In the extended position, the extended adjustable stabilizer blades shift the contact axis such that the areas of contact between the eccentric stabilizer and the borehole form a contact axis which is coincident with the axis of the pilot bit so that the eccentric stabilizer stabilizes the pilot bit in the desired direction of drilling as the eccentric reamer section reams the new borehole.

24 Claims, 20 Drawing Sheets

U.S. PATENT DOCUMENTS

| | | | | |
|---|---|---|---|---|
| 4,407,377 | | 10/1983 | Russell | 175/325.2 |
| 4,465,147 | | 8/1984 | Feenstra et al. | 175/73 |
| 4,560,013 | | 12/1985 | Beimbraben | 175/73 |
| 4,572,305 | | 2/1986 | Swietlik | 175/325.4 |
| 4,591,010 | | 5/1986 | Persson | 175/320 |
| 4,610,307 | | 9/1986 | Jürgens et al. | 175/320 |
| 4,620,600 | | 11/1986 | Persson | 175/73 |
| 4,754,821 | | 7/1988 | Swietlik | 175/325.4 |
| 4,770,259 | | 9/1988 | Jansson | 175/258 |
| 4,811,798 | | 3/1989 | Falgout, Sr. et al. | 175/73 |
| 4,817,740 | | 4/1989 | Beimgraben | 175/74 |
| 4,842,083 | | 6/1989 | Raney | 175/325.4 |
| 4,854,403 | | 8/1989 | Ostertag et al. | 175/325.4 |
| 4,880,066 | * | 11/1989 | Steiginga et al. | 175/75 |
| 4,960,173 | | 10/1990 | Cognevich et al. | 166/241.1 |
| 4,995,465 | * | 2/1991 | Beck et al. | 175/27 |
| 5,038,872 | | 8/1991 | Shirley | 175/76 |
| 5,050,692 | | 9/1991 | Beimgraben | 175/61 |
| 5,052,503 | | 10/1991 | Löf | 175/258 |
| 5,065,826 | * | 11/1991 | Kruger et al. | 175/75 |
| 5,094,304 | * | 3/1992 | Briggs | 175/61 |
| 5,168,941 | | 12/1992 | Krueger et al. | 175/26 |
| 5,265,684 | | 11/1993 | Rosenhauch | 175/61 |
| 5,293,945 | | 3/1994 | Rosenhauch et al. | 175/325.2 |
| 5,311,953 | * | 5/1994 | Walker | 175/61 |
| 5,318,137 | | 6/1994 | Johnson et al. | 175/40 |
| 5,318,138 | | 6/1994 | Dewey et al. | 175/74 |
| 5,332,048 | | 7/1994 | Underwood et al. | 175/26 |
| 5,368,114 | | 11/1994 | Tandberg et al. | 175/267 |
| 5,423,389 | | 6/1995 | Warren et al. | 175/75 |
| 5,511,627 | * | 4/1996 | Anderson | 175/73 |
| 5,520,256 | | 5/1996 | Eddison | 175/61 |
| 5,535,835 | * | 7/1996 | Walker | 175/73 |
| 5,547,031 | | 8/1996 | Warren et al. | 175/61 |
| 5,601,151 | | 2/1997 | Warren | 175/75 |
| 5,655,609 | | 8/1997 | Brown et al. | 175/76 |
| 5,765,653 | * | 6/1998 | Doster et al. | 175/75 |
| 5,836,406 | * | 11/1998 | Schuh | 175/61 |

OTHER PUBLICATIONS

SPE/IADC 25759; *Vertical Drilling Technology: A Milestone in Directional Drilling;;* C. Chur and J. Oppelt; Feb. 23–25, 1993; (pp 789–801).

SPE/IADC 29396; *New Bi–Center Technology Proves Effective in Slim Hole Horizintal Well;;* B. Sketchler, C. Fielder and B. Lee; Feb. 2–Mar. 2, 1995 (p 5).

Oil & Gas Journal; *Use of Bicenter PDC Bit Reduces Drilling Cost;* R. Casto, M. Senese; Nov. 13, 1995; (5 p.).

Halliburton Company; Tracs™; *Adjustable Stabilizer*; (1996); (p. 9).

* cited by examiner

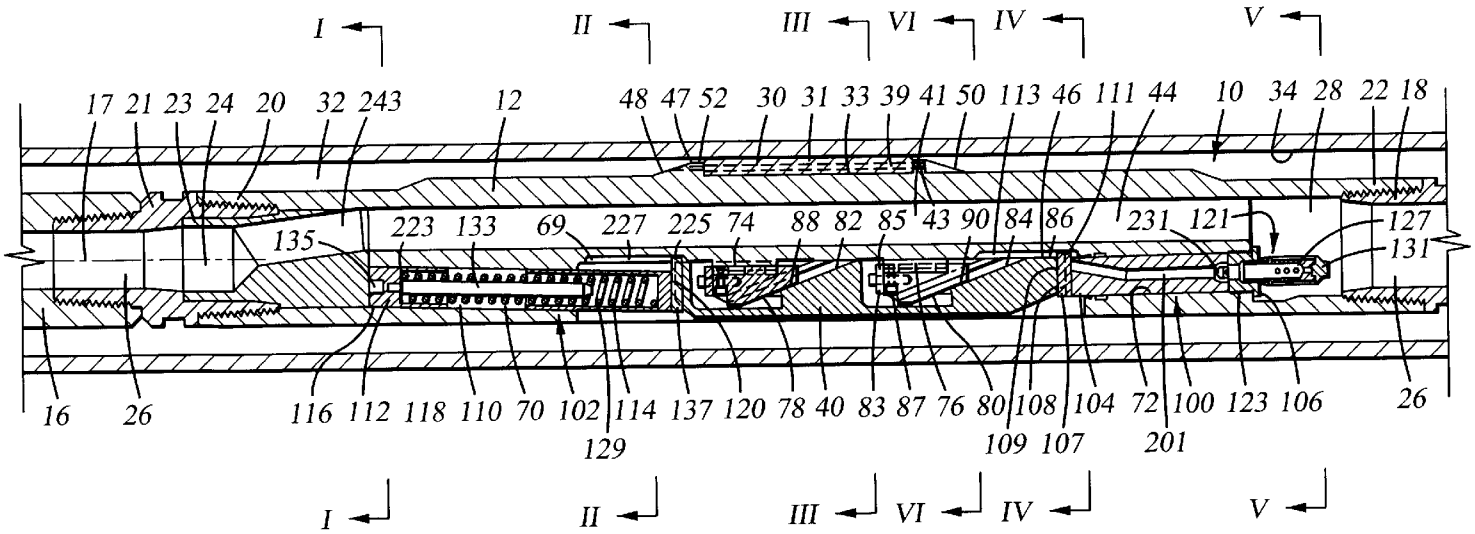
Fig. 1
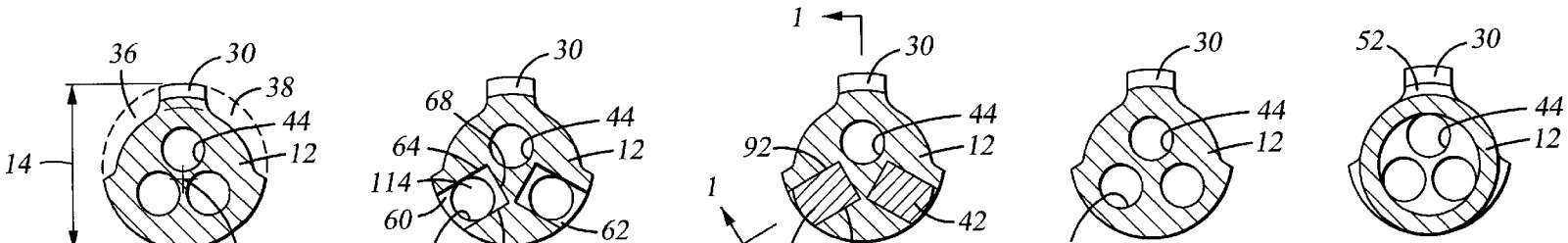
Fig. 2A
Fig. 2B
Fig. 2C
Fig. 2D
Fig. 2E

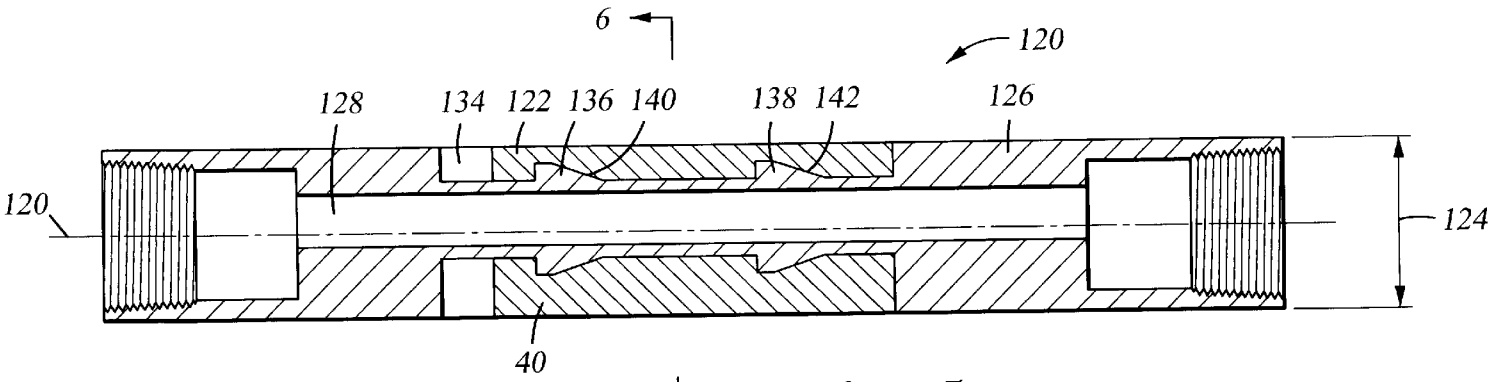
Fig. 5
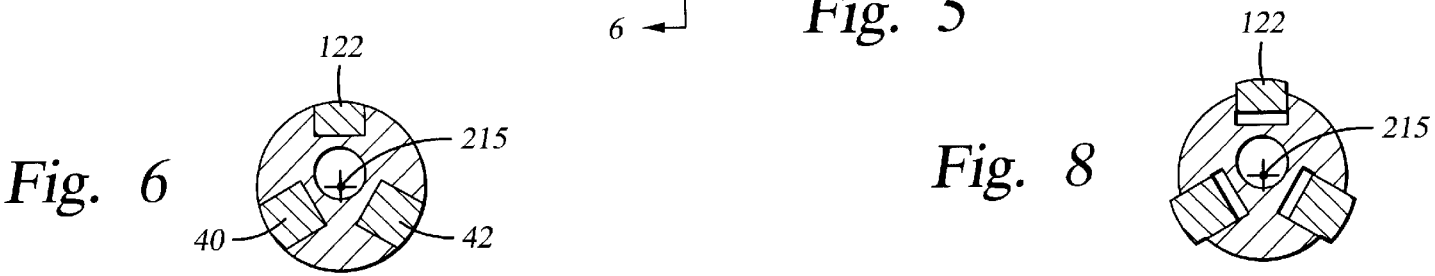
Fig. 8
Fig. 6
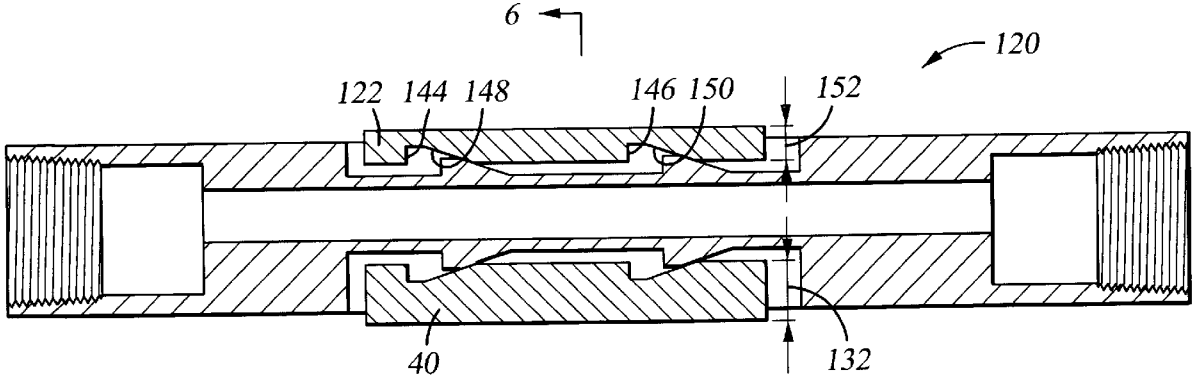
Fig. 7

DIRECTIONAL DRILLING ASSEMBLY AND METHOD

BACKGROUND OF THE INVENTION

The present invention relates to drilling systems for stabilizing and directing drilling bits and particularly to eccentric adjustable diameter stabilizers for stabilizing and controlling the trajectory of drilling bits and more particularly to bi-center bits.

In the drilling of oil and gas wells, concentric casing strings are installed and cemented in the borehole as drilling progresses to increasing depths. In supporting additional casing strings within the previously run strings, the annular space around the newly installed casing string is limited. Further, as successive smaller diameter casings are suspended within the well, the flow area for the production of oil and gas is reduced. To increase the annular area for the cementing operation and to increase the production flow area, it has become common to drill a larger diameter new borehole below the terminal end of the previously installed casing string and existing cased borehole so as to permit the installation of a larger diameter casing string which could not otherwise have been installed in a smaller borehole. By drilling the new borehole with a larger diameter than the inside diameter of the existing cased borehole, a greater annular area is provided for the cementing operation and the subsequently suspended new casing string may have a larger inner diameter so as to provide a larger flow area for the production of oil and gas.

Various methods have been devised for passing a drilling assembly through the existing cased borehole and permitting the drilling assembly to drill a larger diameter new borehole than the inside diameter of the upper existing cased borehole. One such method is the use of underreamers which are collapsed to pass through the smaller diameter existing cased borehole and then expanded to ream the new borehole and provide a larger diameter for the installation of larger diameter casing. Another method is the use of a winged reamer disposed above a conventional bit.

Another method for drilling a larger diameter borehole includes a drilling assembly using a bi-center bit. Various types of bi-center bits are manufactured by Diamond Products International, Inc. of Houston, Tex. See the Diamond Products International brochure incorporated herein by reference.

The bi-center bit is a combination reamer and pilot bit. The pilot bit is disposed on the downstream end of the drilling assembly with the reamer section disposed upstream of the pilot bit. The pilot bit drills a pilot borehole on center in the desired trajectory of the well path and then the eccentric reamer section follows the pilot bit reaming the pilot borehole to the desired diameter for the new borehole. The diameter of the pilot bit is made as large as possible for stability and still be able to pass through the cased borehole and allow the bi-center bit to drill a borehole that is approximately 15% larger than the diameter of the existing cased borehole. Since the reamer section is eccentric, the reamer section tends to cause the pilot bit to wobble and undesirably deviate off center and therefore from the preferred trajectory of drilling the well path. The bi-center bit tends to be pushed away from the center of the borehole because the resultant force of the radial force acting on the reamer blade caused by weight on bit and of the circumferential force caused by the cutters on the pilot bit, do not act across the center line of the bi-center bit. Because this resultant force is not acting on the center of the bi-center bit, the bi-center bit tends to deviate from the desired trajectory of the well path.

The drilling assembly must have a pass through diameter which will allow it to pass through the existing cased borehole. The reamer section of the bi-center bit is eccentric. It is recommended that the stabilizer be located approximately 30 feet above the reamer section of the bi-center bit to allow it to deflect radially without excessive wedging as it is passes through the upper existing cased borehole. If the eccentric reamer section is located closer to the stabilizer, the drilling assembly would no longer sufficiently deflect and pass through the upper existing cased borehole. The stabilizer and collars must allow the bi-center bit to deflect radially without excessive wedging as it passes through the existing cased borehole.

Typically a fixed blade stabilizer is mounted on the drilling assembly. The fixed blade stabilizer includes a plurality of blades azimuthally spaced around the circumference of the housing of the stabilizer with the outer edges of the blades being concentric and adapted to contact the wall of the existing cased borehole. The stabilizer housing has approximately the same outside diameter as the bi-center bit. Obviously, the fixed blade stabilizer must have a diameter which is smaller than the inside diameter of the upper existing cased borehole, i.e. pass through diameter. In fact the fixed blade stabilizer must have a diameter which is equal to or less than outside diameter of the pilot bit of the bi-center bit. Therefore, it can be appreciated that the blades of the fixed blade stabilizer will not all simultaneously contact the wall of the new borehole since the new borehole will have a larger diameter than that of the upper existing cased borehole. By not all of the fixed blades engaging the wall of the new larger diameter borehole, the fixed blade stabilizer is not centralized within the new borehole and often cannot prevent the resultant force on the bi-center bit from causing the center line of the pilot bit from deviating from the center line of the preferred trajectory of the borehole.

An adjustable concentric blade stabilizer may be used on the drilling assembly. The adjustable stabilizer allows the blades to be collapsed into the stabilizer housing as the drilling assembly passes through the upper existing cased borehole and then expanded within the new larger diameter borehole whereby the stabilizer blades engage the wall of the new borehole to enhance the stabilizer's ability to keep the pilot bit center line in line with the center line of the borehole. As the eccentric reamer on the bi-center bit tends to force the pilot bit off center, the expanded adjustable stabilizer blades contacts the opposite side of the new borehole to counter that force and keep the pilot bit on center.

One type of adjustable concentric stabilizer is manufactured by Halliburton, Houston, Texas and is described in U.S. Pat. Nos. 5,318,137; 5,318,138; and 5,332,048, all incorporated herein by reference. Another type of adjustable concentric stabilizer is manufactured by Anderguage U.S.A., Inc., Spring, Tex. See Andergauge World Oil article and brochure incorporated herein by reference.

Even with adjustable concentric blade stabilizers, it is still recommended that the stabilizer be located at least 30 feet above the bi-center bit. The outside diameter of the housing of an adjustable concentric diameter blade stabilizer is slightly greater than the outside diameter of the steerable motor. The adjustable blade stabilizer housing includes a large number of blades azimuthally spaced around its circumference and extending radially from a central flow passage passing through the center of the stabilizer housing. To fit a large number of blades interiorally of the housing, it is necessary to increase the outer diameter of the housing. This produces an offset on the housing. However, the outside diameter of the adjustable stabilizer housing must not exceed the outside diameter of the pilot bit if the adjustable stabilizer is to be located within 30 feet of the bi-center bit. Even if the outside diameter is only increased ½ of an inch, for example, there would not be adequate deflection of the drilling assembly to allow the passage of the drilling assembly down through the existing cased borehole.

The stabilizer is so far away from the bi-center bit that it cannot prevent the eccentric reamer section from tending to push off the wall of the new borehole and cause the pilot bit to deviate from the center line of the trajectory of the well path thereby producing a borehole which is undersized, i.e. produces a diameter which is less than the desired diameter. Such drilling may produce an undersized borehole which is approximately the same diameter as would have been produced by a conventional drill bit.

By locating the stabilizer approximately 30 feet above the bi-center bit, the deflection angle between the stabilizer and the eccentric reamer section is so small that it does not affect the pass through of the drilling assembly. However, as the stabilizer is moved closer to the bi-center bit, the deflection angle becomes greater until the stabilizer is too close to the bi-center bit which causes it to wedge in the borehole and not allow the assembly to pass through the existing cased borehole.

It is preferred that the stabilizer be only two or three feet above the bi-center bit to ensure that the pilot bit drills on center. Having the stabilizer near the bi-center bit is preferred because not only does the stabilizer maintain the pilot bit on center, but the stabilizer also provides a fulcrum for the drilling assembly to direct the drilling direction of the bit. This can be appreciated by an understanding of the various types of drilling assemblies used for drilling in a desired direction whether the direction be a straight borehole or a deviated borehole.

A pendulum drilling assembly includes a fixed blade stabilizer located approximately 30 to 90 feet above the conventional drilling bit with drill collars extending therebetween. The fixed stabilizer acts as the fulcrum or pivot point for the bit. The weight of the drill collars causes the bit to pivot downwardly under the force of gravity on the drill collars to drop hole angle. However, weight is required on the longitudinal axis of the bit in order to drill. The sag of the drill collars below the stabilizer causes the centerline of the drill bit to point above the direction of the borehole being drilled. If the inclination of the borehole is required to decrease at a slower rate, more weight is applied to the bit. The greater resultant force in the upward direction from the increased weight on bit, offsets part of the side force from the drill collar weight causing the borehole to be drilled with less drop tendency. Oftentimes the pendulum assembly is used to drop the direction of the borehole back to vertical. The pendulum assembly's directional tendency is very sensitive to weight on bit. Usually the rate of penetration for drilling the borehole is slowed down dramatically in order to maintain an acceptable near vertical direction.

A packed hole drilling assembly typically includes a conventional drill bit with a lower stabilizer approximately 3 feet above the bit, an intermediate stabilizer approximately 10 feet above the lower stabilizer and then an upper stabilizer approximately 30 feet above the intermediate stabilizer. A fourth stabilizer is not uncommon. Drill collars are disposed between the stabilizers. Each of the stabilizers are full gauge, fixed blade stabilizers providing little or no clearance between the stabilizer blades and the borehole wall. The objective of a packed hole drilling assembly is to provide a short stiff drilling assembly with as little deflection as possible so as to drill a straight borehole. The packed hole assembly's straight hole tendency is normally insensitive to bit weight.

A rotary drilling assembly can include a conventional drilling bit mounted on a lower stabilizer which is typically disposed 2½ to 3 feet above the bit. A plurality of drill collars extends between the lower stabilizer and other stabilizers in the bottom hole assembly. The second stabilizer typically is about 10 to 15 feet above the lower stabilizer. There could also be additional stabilizers above the second stabilizer. Typically the lower stabilizer is 1/32 inch under gage to as much as ¼ inch under gage. The additional stabilizers are typically ⅛ to ¼ inch under gage. The second stabilizer may be either a fixed blade stabilizer or more recently an adjustable blade stabilizer. In operation, the lower stabilizer acts as a fulcrum or pivot point for the bit. The weight of the drill collars on one side of the lower stabilizer can move downwardly, until the second stabilizer touches the bottom side of the borehole, due to gravity causing the longitudinal axis of the bit to pivot upwardly on the other side of the lower stabilizer in a direction so as to build drill angle. A radial change of the blades, either fixed or adjustable, of the second stabilizer can control the vertical pivoting of the bit on the lower stabilizer so as to provide a two dimensional gravity based steerable system so that the drill hole direction can build or drop inclination as desired.

Steerable systems, as distinguished from rotary drilling systems, include a bottom hole drilling assembly having a steerable motor for rotating the bit. Typically, rotary assemblies are used for drilling substantially straight holes or holes which can be drilled using gravity. Gravity can be effectively used in a highly deviated or horizontal borehole to control inclination. However, gravity can not be used to control azimuth. A typical bottom hole steerable assembly includes a bit mounted on the output shaft of a steerable motor. A lower fixed or adjustable blade stabilizer is mounted on the housing of the steerable motor. An adjustable blade stabilizer on the motor housing is not multi-positional and includes either a contracted or expanded position. The steerable motor includes a bend, typically between ¾° and 3°. Above the steerable motor is an upper fixed or concentrically adjustable blade stabilizer or slick assembly. Typically, the lower fixed blade stabilizer is used as the fulcrum or pivot point whereby the bottom hole assembly can build or drop drilling angle by adjusting the blades of the upper concentrically adjustable stabilizer. The upper concentrically adjustable stabilizer may be multi-positional whereby the stabilizer blades have a plurality of concentric radial positions from the housing of the stabilizer thereby pivoting the bit up or down by means of the fulcrum of the lower fixed blade stabilizer. It is known to mount a concentric adjustable blade stabilizer below the motor on the motor's output shaft between the bit and the motor with the concentric adjustable blade stabilizer rotating with the bit. One of the principal advantages of the steerable motor is that it allows the bit to be moved laterally or change azimuth where a conventional rotary assembly principally allows the bit to build or drop drilling angle.

The steerable drilling assembly includes two drilling modes, a rotary mode and a slide mode. In the rotary drilling mode, not only does the bit rotate by means of the steerable motor but the entire drill string also rotates by means of a rotary table on the rig causing the bend in the steerable motor to orbit about the center line of the bottom hole assembly. Typically the rotary drilling mode is used for drilling straight ahead or slight changes in inclination and is preferred because it offers a high drilling rate.

The other drilling mode is the slide mode where only the bit rotates by means of the steerable motor and the drill string is no longer rotated by the rotary table at the surface. The bend in the steerable motor is pointed in a specific direction and only the bit is rotated by fluid flow through the steerable motor to drill in the preferred direction, typically to correct the direction of drilling. The remainder of the bottom hole assembly then slides down the hole drilled by the bit. The rotation of the bit is caused by the output of the drive shaft of the steerable motor. The slide mode is not preferred because it has a much lower rate of drilling or penetration rate than does the rotary mode.

It can be seen that the rotary assembly and the steerable assembly with a conventional drill bit rely upon a stabilizer to act as a fulcrum or pivot point for altering the direction of drilling of the bit. When a bi-center bit is used with these drilling assemblies, near bit stabilization cannot be achieved because the nearest stabilizer can only be located approximately 30 feet above the bi-center bit because the drilling assembly must pass through the upper existing cased borehole. With the closest stabilizer being 30 feet above the bi-center bit, the drilling assembly becomes a pendulum drilling assembly and, as previously discussed, poses a problem for controlling the center line of the pilot bit and thus the direction of drilling. As with a pendulum assembly, the bit is tilted in a direction to build angle. With a normal pendulum assembly, the gravitational force acts on the bit to cause it to side cut to the low side so that the bit tilt effect may not be predominate, depending on weight on bit, drilling rate, rock properties, bit design, etc. For most bi-center bits, the lateral force from the reamer is greater than the gravity force at low inclinations, thus the bit does not side cut only on the low side, but cuts in all directions around the hole. This causes the bit tilt to predominate and, thus the bi-center bit may build angle more readily than a standard bit. Thus it can be seen that the best possible bottom hole assembly with a bi-center bit has greater instability than a comparable bottom hole assembly with a standard bit. Because of this instability, rotary assemblies with fixed blade stabilizers would require constant changing, tripping in and out of the borehole, to change to a stabilizer with a different diameter for borehole inclination correction. Also, because of this instability, steerable assemblies require a lot of reorienting of the hole direction to correct the direction of drilling, thus requiring the use of the sliding mode of drilling with its low penetration rate.

Also, drilling in the sliding mode often produces an abrupt dog leg or kink in the borehole. Ideally, there should be no abrupt change in direction. Although a gradual consistent dog leg of 2° in 100 feet is not detrimental, and an abrupt change of 2° at one location every 100 feet is detrimental. Abrupt changes in drilling trajectory causes tortuosity. Tortuosity is a term describing a borehole which has the trajectory of a corkscrew which causes the borehole to have many changes in direction forming a very tortuous well path through which the bottom hole assembly and drill string trip in and out of the well. Tortuosity substantially increases the torque and drag on the drill string. In extended reach drilling, tortuosity limits the distance that the drill string can drill and thus limits the length of the extended reach well. Tortuosity also limits the torque that can effectively be placed in the bottom hole assembly and causes the drill string or bottom hole assembly to get stuck in the borehole. The article, entitled "Use of Bicenter PDC Bit Reduces Drilling Cost" by Robert G. Casto in the Nov. 13, 1995 issue of Oil & Gas Journal, describes the deficiencies of drilling in the slide mode. It should be appreciated that rig costs are extraordinarily expensive and therefore it is desirable to limit slide mode drilling as much as possible.

The prior art previously discussed is more directed to lower angle drilling. For high angle drilling, the reamer section of the bi-center bit tends to ream and undercut the bottom side of the hole causing the bit to drop angle. This is very formation dependant and makes the bi-center bit even more unstable and unpredictable.

The present invention overcomes the deficiencies of the prior art.

SUMMARY OF THE INVENTION

The method and apparatus of the present invention includes a drilling assembly having an eccentric adjustable diameter blade stabilizer. The eccentric stabilizer includes a housing having a fixed stabilizer blade and a pair of adjustable stabilizer blades. The adjustable stabilizer blades are housed within openings in the housing of the eccentric stabilizer. An extender piston is housed in a piston cylinder for engaging and moving the adjustable stabilizer blades to an extended position and a return spring is disposed in the stabilizer housing and operatively engages the adjustable stabilizer blades for returning them to a contracted position. The housing includes cam surfaces which engage corresponding inclined surfaces on the stabilizer blades such that upon axial movement of the adjustable stabilizer blades, the blades are cammed outwardly into their extended position. The eccentric stabilizer also includes one or more flow tubes through which passes drilling fluids applying pressure to the extended piston such that the differential pressure across the stabilizer housing actuates the extender pistons to move the adjustable stabilizer blades axially upstream for camming into their extended position.

The eccentric stabilizer is mounted on a bi-center bit which has an eccentric reamer section and a pilot bit. In the contracted position, the areas of contact between the eccentric stabilizer and the borehole forms a contact axis which is coincident with the axis of the bi-center bit. In the extended position, the extended adjustable stabilizer blades shift the contact axis such that the areas of contact between the eccentric stabilizer and the borehole form a contact axis which is coincident with the axis of the pilot bit. In operation, the adjustable blades of the eccentric stabilizer are in their contracted position as the drilling assembly passes through the existing cased borehole and then the adjustable blades are extended to their extended position to shift the contact axis so that the eccentric stabilizer stabilizes the pilot bit in the desired direction of drilling as the eccentric reamer section reams the new borehole. Once drilling is completed, the blades are retracted by the retractor spring when the flow is turned off so that the assembly can pass back up through the existing cased borehole to surface.

The eccentric stabilizer of the present invention allows the stabilizer to be a near bit stabilizer such that the stabilizer may be located within a few feet of the bi-center bit. By locating the eccentric stabilizer near the bi-center bit, and by raising and lowering drill collars connected upstream of the eccentric stabilizer, the eccentric stabilizer acts as a fulcrum to adjust the direction of drilling of the bi-center bit. Also, by locating the stabilizer near the bi-center bit, stability of the bottom hole assembly is greatly improved and greatly reduces stresses due to whirl at previously unstabilized areas of the bottom hole assembly. It should also be appreciated that the present invention is not limited to use as a near bit stabilizer but can also be used as a string stabilizer.

Other objects and advantages of the invention will appear from the following description.

BRIEF DESCRIPTION OF THE DRAWINGS

For a detailed description of a preferred embodiment of the invention, reference will now be made to the accompanying drawings wherein:

FIG. 1 is a cross-sectional elevation view of the eccentric adjustable diameter blade stabilizer of the present invention in the borehole with the adjustable blades shown in the contracted position;

FIG. 2A is a cross-section view taken at plane I in FIG. 1 showing the flow tube and spring cylinders;

FIG. 2B is a cross-section view taken at plane II in FIG. 1 showing the retractor pistons;

FIG. 2C is a cross-section view taken at plane III in FIG. 1 showing the adjustable blades in the contracted position;

FIG. 2D is a cross-section view taken at plane IV in FIG. 1 showing the flow tube and the piston cylinders;

FIG. 2E is a cross-section view taken at plane V in FIG. 1 showing the downstream end of the stabilizer;

FIG. 5 is a cross-sectional elevation view of an alternative embodiment of the eccentric adjustable diameter blade stabilizer of the present invention having three adjustable stabilizer blades;

FIG. 6 is a cross-section view taken at plane 6 in FIG. 5 showing the three adjustable blades in the contracted position;

FIG. 7 is a cross-sectional elevation view of the alternative embodiment of FIG. 5 showing the adjustable blades in the extended position;

FIG. 8 is a cross-section view taken at plane 8 in FIG. 7 showing the three adjustable blades in the extended position;

DESCRIPTION OF PREFERRED EMBODIMENTS

Figure 3:
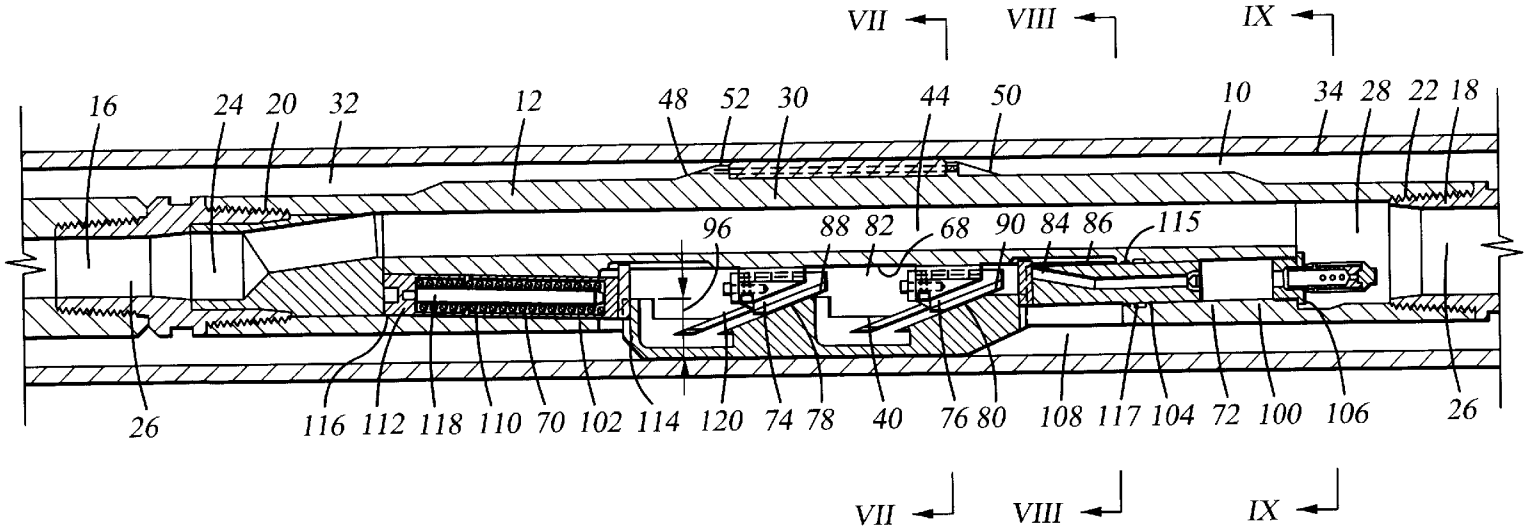
FIG. 3 is a cross-sectional elevation view of the eccentric adjustable diameter blade stabilizer of FIG. 1 with the adjustable blades in the extended position.

The present invention relates to methods and apparatus for stabilizing bits and changing the drilling trajectory of bits in the drilling of various types of boreholes in a well. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

In particular, various embodiments of the present invention provide a number of different constructions and methods of operation of the drilling system, each of which may be used to drill one of many different types of boreholes for a well including a new borehole, an extended reach borehole, extending an existing borehole, a sidetracked borehole, a deviated borehole, enlarging a existing borehole, reaming an existing borehole, and other types of boreholes for drilling and completing a pay zone. The embodiments of the present invention also provide a plurality of methods for using the drilling system of the present invention. It is to be fully recognized that the different teachings of the embodiments discussed below may be employed separately or in any suitable combination to produce desired results.

Referring initially to FIGS. 1 and 2A–E, there is shown an eccentric adjustable diameter blade stabilizer, generally indicated by arrow 10. Referring particularly to FIG. 2A, the stabilizer 10 includes a generally tubular-like housing 12 having an axis 17 and a primary thickness or diameter 14 approximately equal to the pass-through diameter of the drill collars 16 and the other components 18 attached thereto for forming one of the assemblies hereinafter described. Housing 12 includes threaded box ends 20, 22 at each end of housing 12. Upstream box end 20 is connected to a threaded pin end of a tubular adapter sub 21 which in turn has another pin end connected to the box end of drill collar 16. The downstream box end 22 is connected to the other drilling assembly components 18. The other components of the drilling assembly and drill string (not shown) form an annulus 32 with the wall of either the existing cased borehole or new borehole, as the case may be, generally designated as 34.

In this preferred embodiment of the present invention, stabilizer 10 further includes three contact members which contact the interior wall of borehole 34, namely a fixed stabilizer blade 30 and a pair of adjustable stabilizer blades 40, 42, each equidistantly spaced apart approximately 120° around the circumference of housing 12. It should be appreciated that the cross-sections shown in FIGS. 1 and 3 pass through blades 30 and 40 by draftsman's license as shown in FIG. 2C for added clarity. Each of the stabilizer blades 30, 40, 42 includes an upstream chamfered or inclined surface 48 and a downstream chamfered or inclined surface 50 to facilitate passage of the stabilizer 10 through the borehole 34.

It can be seen from the cross-section shown in FIG. 2A, that the general cross-section of housing 12 is circular with the exception of arcuate phantom portions 36, 38 which extend in the direction of the fixed blade 30 to reduce housing 12 adjacent each side of fixed stabilizer blade 30. These reduced sections reduce the weight of housing 12 and allow enhanced fluid flow through annulus 32 around stabilizer 10. The reduced sections 36, 38 also allow the adjustment of the center of gravity of the weight of the eccentric adjustable blade stabilizer 10 to compensate for the offset of the weight of the stabilizer 10 and/or the weight of the reamer section of the bi-center bit, hereinafter described in further detail. As shown in FIG. 2A, reduced sections 36, 38 cause the center of gravity to be lowered on the eccentric adjustable blade stabilizer 10. Thus the weight of the stabilizer 10 is adjusted on the fixed pad of the bottom hole assembly or the bi-center, bit-eccentric stabilizer assembly is balanced by removing material from the stabilizer housing 12 near the fixed blade 30 such that the eccentric adjustable blade stabilizer 10 compensates for the offset weight of the reamer section and allows more weight opposite the reamer section on the bottom hole assembly and also helps centralize the weight on the bottom hole assembly, hereinafter described in detail.

A flowbore 26 is formed by drill collars 16 and the upstream body cavity 24 of housing 12 and by the other drilling assembly components 18 and downstream body cavity 28 of housing 12. Housing 12 includes one or more off-center flow tubes 44 allowing fluid to pass through the stabilizer 10. Flow tube 44 extends through the interior of housing 12, preferably on one side of axis 17, and is integrally formed with the interior of housing 12. A flow direction tube 23 is received in the upstream end of housing 12 to direct fluid flow into flow tube 44. Flow direction tube 23 is held in place by adapter sub 21. The downstream end of flow direction tube 23 includes an angled aperture 243 which communicates the upstream end of flow tube 44 with the upstream body cavity 24 communicating with flowbore 26. The downstream end of flow tube 44 communicates with the downstream body cavity 28 of housing 12. It should be appreciated that additional flow tubes may extend through housing 12 with flow direction tube 23 directing flow into such additional flow tubes.

The flow tube 44 is off center to allow adjustable stabilizer blades 40, 42 to have adequate size and range of radial motion, i.e. stroke. Housing 12 must provide sufficient room for blades 40, 42 to be completely retracted into housing 12 in their collapsed position as shown in FIG. 1. Having the flow tube 44 off center requires that fluid flow through flowbore 26 be redirected by flow direction tube 23. Although the flow area through flowbore 44 is smaller than that of flowbore 26, the flow area is large enough so that there is little increase in velocity of fluid flow through flow tube 44 and so that there is a small pressure drop and no erosion occurs from sufficient flow through flow tube 44. The flow is sufficient to cool and remove cuttings from the bit and in the case of a steerable system, to drive the down-hole motor.

Figure 2F:
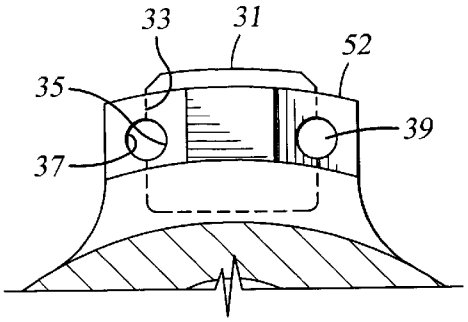
FIG. 2F is an end view of the fixed stabilizer blade taken at plane VI in FIG. 1.
Figure 10:
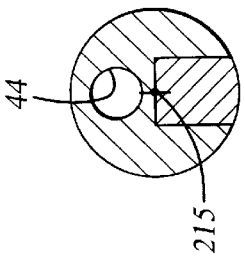
FIG. 10 is a cross-section view taken at plane 10 in FIG. 9 showing the adjustable blade in its contracted position.
Figure 9:
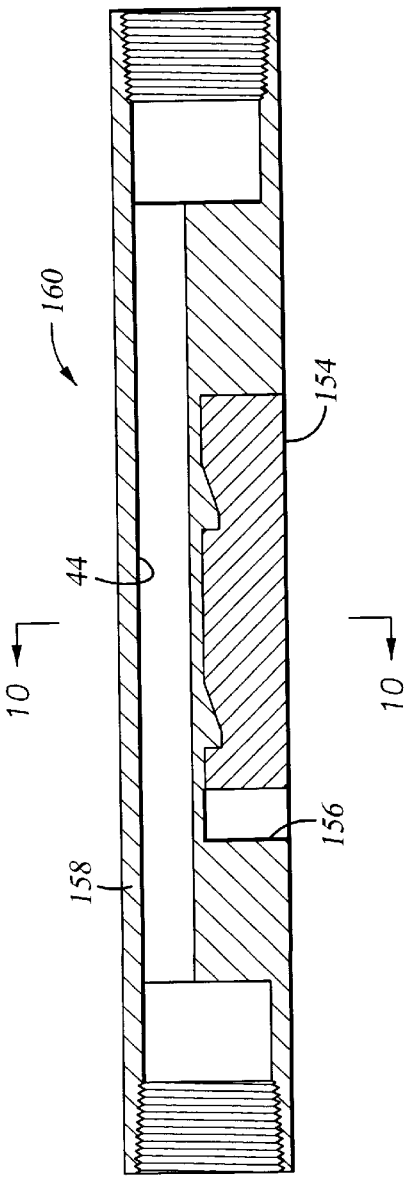
FIG. 9 is a cross-sectional elevation view of still another embodiment of the eccentric adjustable diameter blade stabilizer of the present invention having a single adjustable blade shown in the contracted position.
Figure 12:
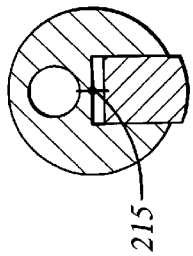
FIG. 12 is a cross-section view taken at plane 12 in FIG. 11 showing the adjustable blade in the extended position.
Figure 11:
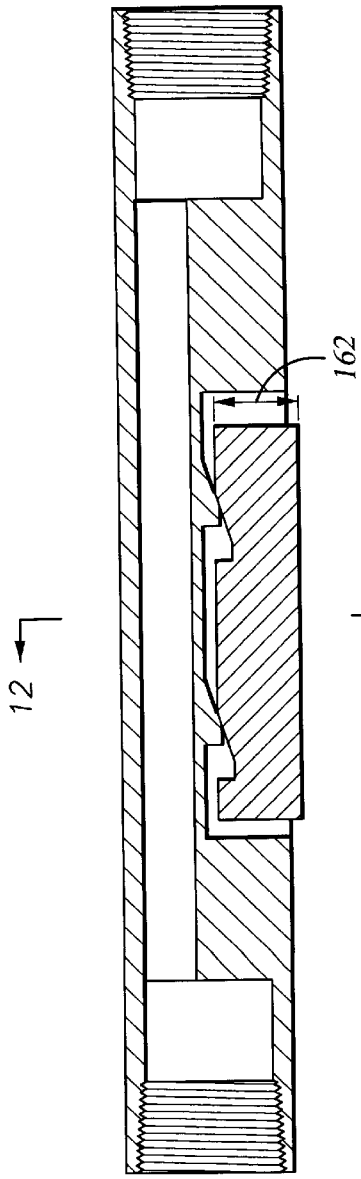
FIG. 11 is a cross-sectional elevation view of the stabilizer of FIG. 9 showing the adjustable blade in the extended position.
Figure 14:
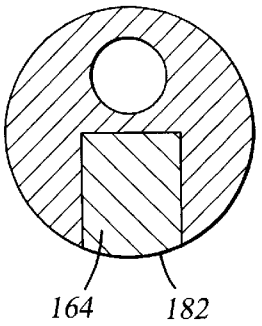
FIG. 14 is a cross-section view taken at plane 14 of FIG. 13 showing the buttons in the contracted position.
Figure 16:
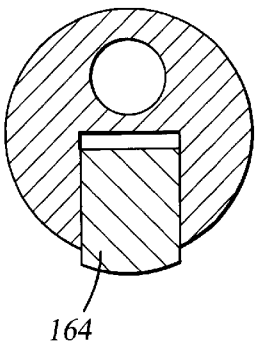
FIG. 16 is a cross-section view taken at plane 16 in FIG. 15 showing the buttons in the extended position.
Figure 13:
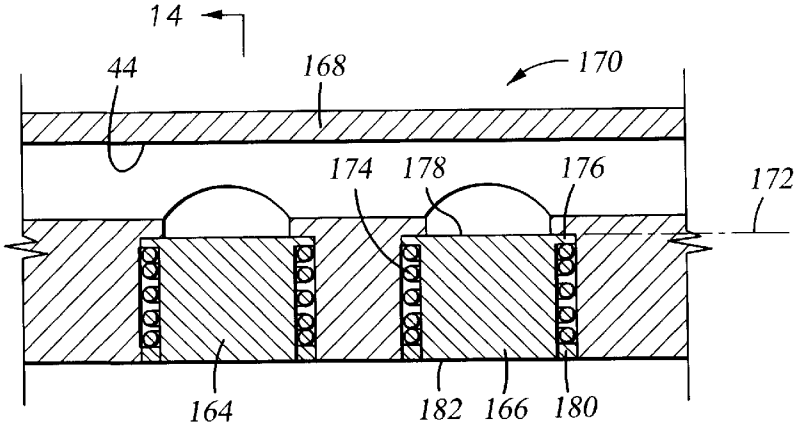
FIG. 13 is a still another embodiment of the eccentric adjustable diameter blade stabilizer of the present invention shown in FIGS. 9–12 with this embodiment having buttons shown in the contracted position.
Figure 15:
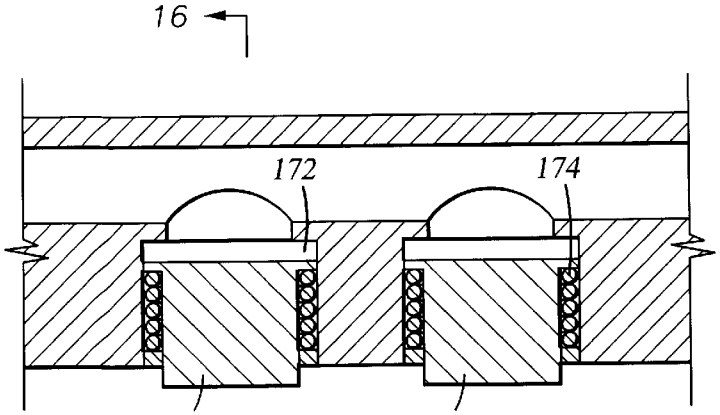
FIG. 15 is a cross-sectional elevation view of the stabilizer shown in FIG. 13 showing the buttons in the extended position.

Referring now to FIGS. 1 and 2F, although the fixed blade 30 may be integral with housing 12, fixed blade 30 is preferably a replaceable blade insert 31 disposed in a slot 33 in an upset 52 projecting from housing 12 thus allowing for the adjustment of the amount of radial projection of the fixed blade 30 from the housing 12. Replaceable blade insert 31 includes a C-shaped dowel groove 35 on each longitudinal side thereof which aligns with a C-shaped groove 37 in each of the side walls forming slot 33 in upset 52. Upset 52 includes a pair of reduced upstream bores 47 and a pair of full sized downstream bores 43. Dowel pins 39 extend full length through full size downstream bores 43 and grooves 35, 37 to secure insert 31 in slot 33. Spiral spring pins 41 are disposed in full size downstream bores 43 to secure the dowel pins 39 in place within grooves 35, 37. It should be appreciated that other means may be used to secure insert 31 within slot 33 such as bolts threaded into tapped holes in the housing 12. Replaceable inserts 31 serve as a pad mounted on the housing 12. The insert 31 may have a different thickness and be mounted in slot 33. If the eccentric adjustable blade stabilizer 10 is to be run near the bit, on gauge, then the fixed blade 30 is of one predetermined diameter. However, if the bit is to be run $1/8^{th}$ inch under gauge, then the diameter of the fixed blade 30 is reduced to a $1/16^{th}$ inch less.

The adjustable stabilizer blades 40, 42 are housed in two axially extending pockets or blade slots 60, 62 extending radially through the mid-portion of housing 12 on one side of axis 17. Because the adjustable blades 40, 42 and slots 60, 62, respectively, are alike, for the sake of simplicity, only adjustable blade 40 and slot 60 shown in FIGS. 1 and 3 will be described in detail. In describing the operation of stabilizer 10, distinctions between the operation of the blades 40, 42 and slots 60, 62 will be referred to in detail.

Referring particularly to FIGS. 1 and 2B, slot 60 has a rectangular cross-section with parallel side walls 64, 66 and a base wall 68. Blade slot 60 communicates with a return cylinder 70 extending to the upstream body cavity 24 of flow direction tube 23 and with an actuator cylinder 72 extending to the downstream body cavity 28 of housing 12. Blade slot 60 communicates with body cavities 24, 28 only at the ends of the slot leaving flow tube 44 integral to the housing 12 and to the side walls 64, 66 of slot 60, to transmit flow therethrough.

Figure 53:
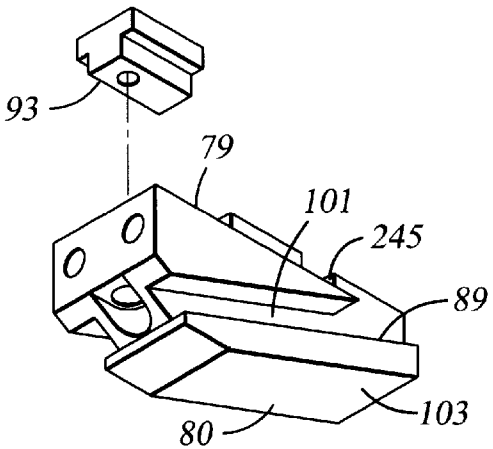
FIG. 53 is a perspective view of the ramp for the cam member of FIG. 52.
Figure 52:
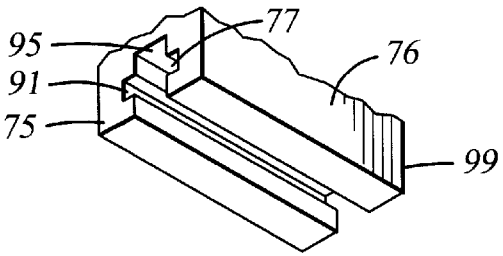
FIG. 52 is a perspective view of the cam member for the eccentric adjustable diameter blade stabilizer of FIG. 1.
Figure 55:
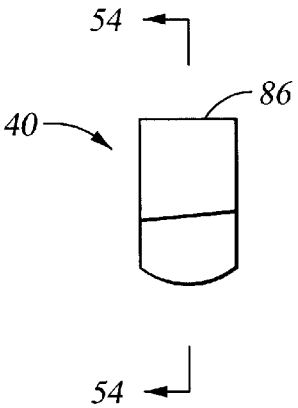
FIG. 55 is an end view of the blade of FIG. 54.
Figure 54:
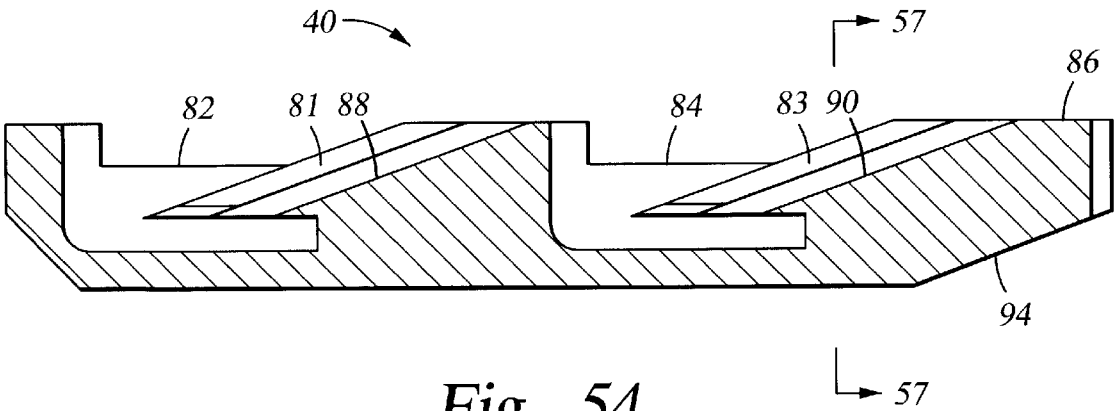
FIG. 54 is a cross sectional view of the blade of the stabilizer of FIG. 1.
Figure 57:
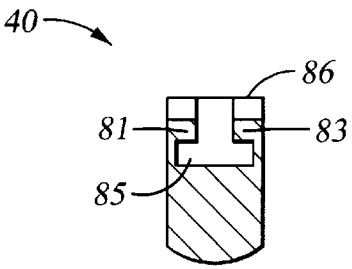
FIG. 57 is a cross sectional view taken at plane 57—57 in FIG. 54.
Figure 56:
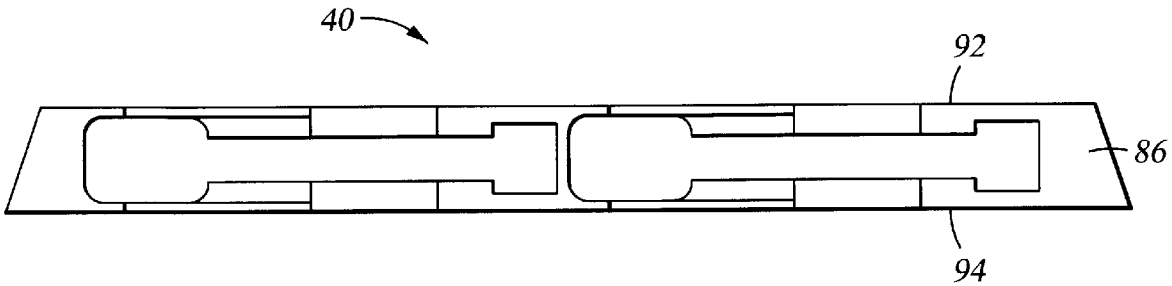
FIG. 56 is a bottom view of the blade shown in FIG. 54.

Referring now to FIGS. 1, 52, and 53, slot 60 further includes a pair of cam members 74, 76, each forming a inclined surface or ramp 78, 80, respectively. Although cam members 74, 76 may be integral to housing 12, cam members 74, 76 preferably include a cross-slot member and a replaceable ramp member. Referring particularly to FIGS. 52 and 53, there is shown cam member 76 having a cross-slot member 75 forming a cross shaped slot 77 for receiving a replaceable ramp member 79 having ramp 80. Ramp member 79 has a T-shaped cross-section which is received in the outer radial portion 91 of the cross shaped slot 77 and an end shoulder 245 for abutting against one end 99 of cross-slot member 75. The inner radial portion 95 of cross shaped slot 77 is open to allow fluid flow through cam member 76. A pair of bolts 83 with end washer 85 are threaded into the other end of ramp member 79 for drawing end shoulder 245 tight against end 99 of cross-slot member 75. A transverse bolt 87 passes through the outer radial portion 91 of ramp member 79 and is threaded into a fastener plate 93 received in outer radial portion 91. Bolts 83, 87 lock replaceable ramp member 79 in place and keep it from sliding out of the cross-slot 77 and from fluctuating radially in the cross-slot 77. This prevents any fretting of the ramp 80 with respect to the cam member 76. The ramp members 79 may be changed so as to change slightly the angle of the ramps 78, 80. Ramp member 79 also includes slots 101 forming a T-shaped head 103.

Referring now to FIGS. 1 and 54–57, adjustable stabilizer blade 40 is positioned within slot 60. Blade 40 is a generally elongated, planar member having a pair of notches 82, 84 in its base 86. Notches 82, 84 each form a ramp or inclined surface 88, 90, respectively, for receiving and cammingly engaging corresponding cam members 74, 76 with ramps 78, 80, respectively. Opposing rails 81, 83 parallel ramps 88, 90 to form a T-shaped slot 85. The T-shaped head 103 of ramp member 79 is received within T-shaped slot 85 causing flutes 89 on the inner side of head 103 of ramp member 79 to engage rails 81, 83 to retain blade 40 within slot 60 and maintain blade 40 against ramp 80. The corresponding ramp surfaces 78, 88 and 80, 90 are inclined or slanted at a predetermined angle with axis 17 to cause blade 60 to move radially outward a predetermined distance or stroke as blade 40 moves axially upward and to move radially inward as blade 40 moves axially downward. FIGS. 1 and 2A–E illustrate blade 40 in its radially inward and contracted position and FIGS. 3 and 4A–C illustrate blade 40 in its radially outward and extended position.

It is preferred that the width 96 of blade 40 be maximized to maximize the stroke of blade 40. The width of blade 40 is determined by the position and required flow area of flow tube 44 and by maintaining at least some thickness of the wall between the base 68 of slot 60 and the closest wall of flow tube 44. Although the length of blade 40 is similar, blade 40 has a greater width than that of the blades in other adjustable concentric blade stabilizers by disposing flow tube 44 off center of the housing 12, thus permitting a larger radial stroke of the blade as shown in FIG. 3.

There must be sufficient bearing area or support on each planar side 92, 94 of blade 40 to maintain blade 40 in slot 60 of the housing 12 during drilling. When blade 40 is in its extended position, it is preferred that a greater planar area of blade 40 project inside slot 60 than project outside slot 60. It is still more preferred that at least approximately 50% of the surface area of side 92 of the blade 40 be in bearing area contact with the corresponding wall of slot 60 in the extended position. The bearing area contact of the present invention may be up to six times greater than that of prior art blades. The support of the blade by the stabilizer body is very important since, without that support, the blades might tend to rock out of the slots during drilling. Thus, the adjustable blades 40, 42 of the present invention not only have a greater stroke than that of the prior art but also provide greater bearing area contact between the blades and housing.

Figure 44:
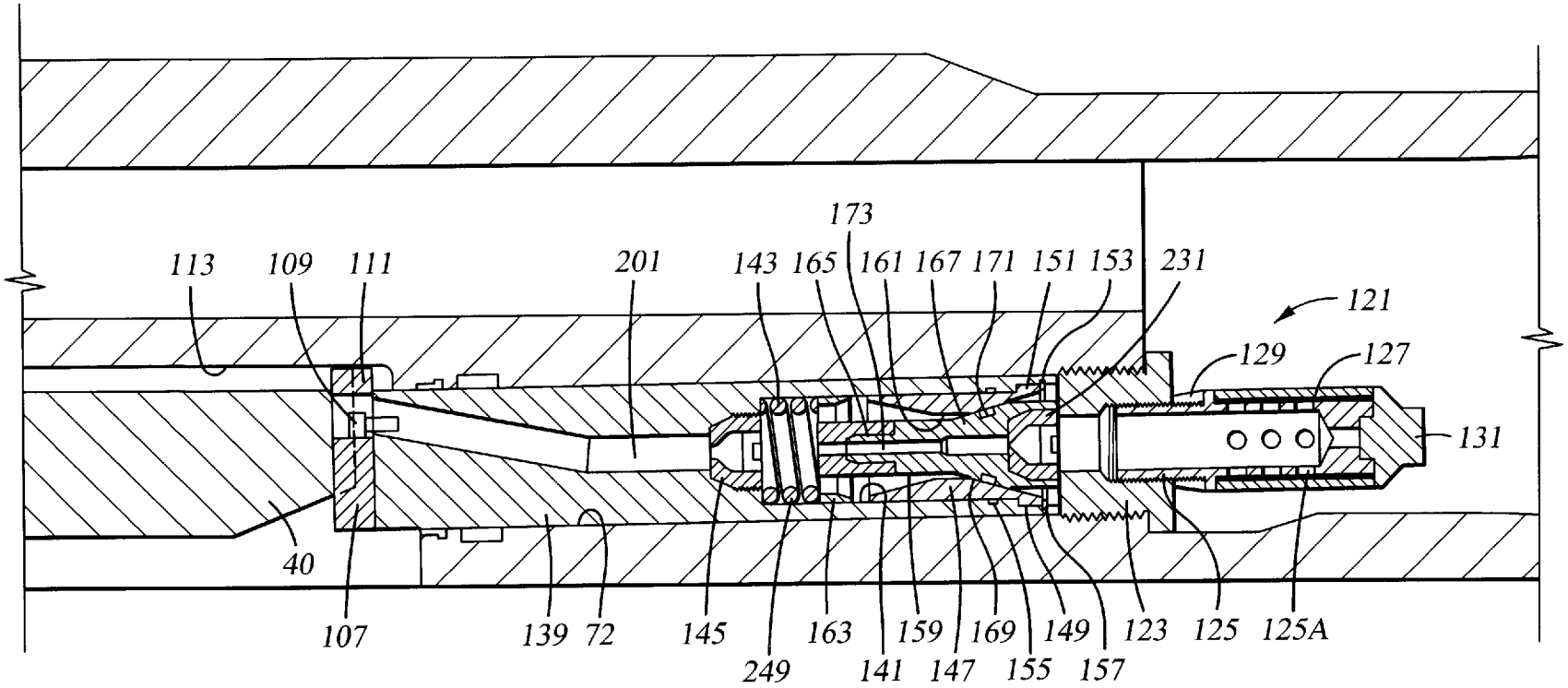
FIG. 44 is a cross-section of an alternative embodiment of the actuator piston in the contracted position for the eccentric adjustable diameter blade stabilizer of FIG. 1.
Figure 45:
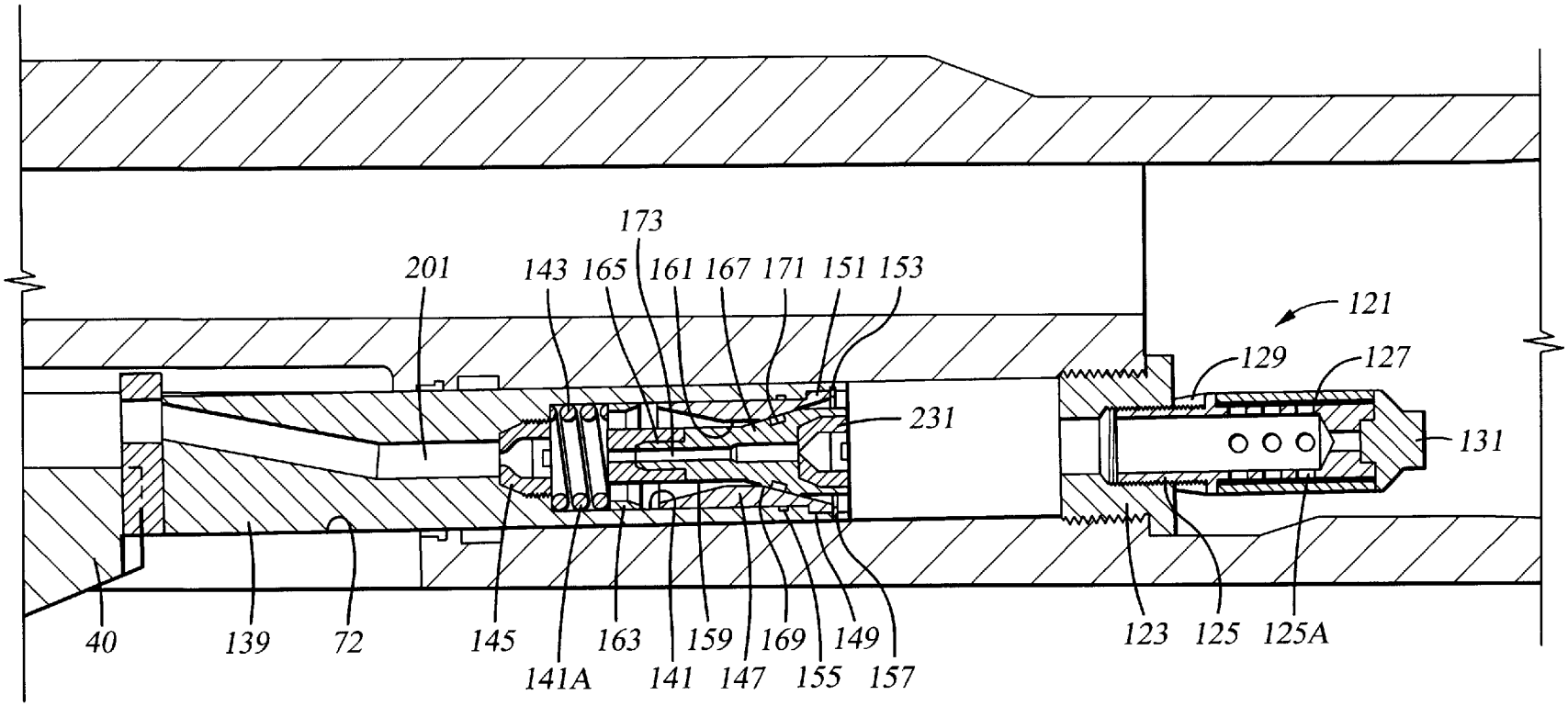
FIG. 45 is a cross-section of the actuator piston of FIG. 44 in the extended position.
Figure 46:
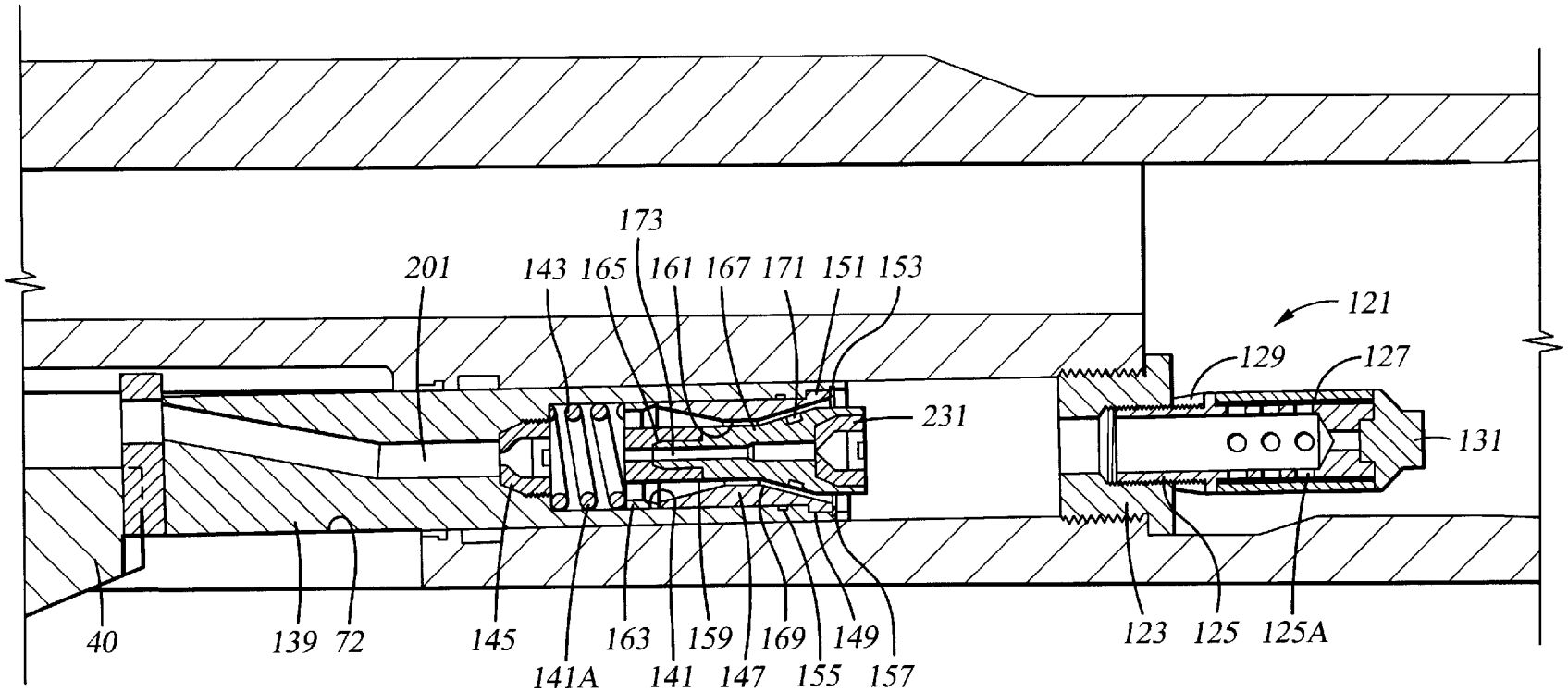
FIG. 46 is a cross-section of the actuator piston of FIG. 44 in a partially contracted position.

Referring now to FIGS. 1 and 3 and also to FIGS. 44–46 of an alternative embodiment of the extender, stabilizer 10 includes an actuation means with an extender 100 for extending blades 40, 42 radially outward to their extended position shown in FIG. 3 and a contractor 102 for contracting blades 40, 42 radially inward to their contracted position shown in FIG. 1. The expander 100 includes an extender rod or piston 104 reciprocably mounted within actuator cylinder 72. A flow passageway 201 extends from the axis of piston 104 at inlet port 105 and then angles towards the base 68 of slot 60 to allow the fluid to flow toward the bottom of slot 60. A nozzle 231 is threaded into the inlet port 105 of the flow passageway 201 at the downstream end 106 of actuator cylinder 72. A key cap 107 is bolted at 109 to the upstream end 108 of piston 104. Key cap 107 includes a key 111 received in a channel 113 in the base 68 of slot 60 for preventing rotation and maintaining alignment of piston 104 within cylinder 72. A wiper 115 and seal 117 are housed in cylinder 72 for engagement with piston 104.

A filter assembly 121, best shown in FIG. 44 of an alternative embodiment of the extender, is mounted in the entrance port 105 of cylinder 72. Assembly 121 includes a retainer nut 123 threaded into the cylinder 72 and a sleeve 125, with apertures 125A, threaded into the end of retainer nut 123. A screen 127 of a tubular mesh is received over sleeve 125 and held in place by spacer 129 and threaded end cap 131. Actuator piston 104 has its downstream end 106 exposed to the fluid pressure at downstream body cavity 28 of housing 12 and its upstream end 108 in engagement with the downstream terminal end of blade 60 and exposed to the fluid pressure in the annulus 32. The screen 127 and sleeve 125 allow the cleaner fluid passing through the inner flow tube 44 to pass into the actuator cylinder 72, through the nozzle 103 and passageway 201 to slot 60 housing blade 40. The fluid then flows into the annulus 34. This fluid flow cleans and washes the cuttings out of the bottom of the slot 60 to ensure that blade 40 will move back to its contracted position as shown in FIG. 1.

The contractor 102 includes a return spring 110 disposed within spring cylinder 70 and has its upstream end received in the bore of an upstream retainer 112 and its downstream end received in the bore of a downstream retainer 114. Upstream retainer 112 is threaded at 116 into the upstream end of cylinder 70 and has seals 118 to seal cylinder 70. A spring support dowel 133 extends into the return spring 110. Dowel 133 has a threaded end 223 which shoulders against retainer 112 and is threaded into a threaded bore in upstream retainer 112. The dowel 133 has a predetermined length such that the other terminal end 129 of dowel 133 engages downstream retainer 114 to limit the travel or stroke of blade 40. The length of dowel 133 may be adjusted by adding or deleting washers disposed between the shoulder of threaded end 223 and retainer 112. Wrench flats 135 are provided for the assembly of retainer 112. It should be appreciated that a key cap 137, like cap 107, is disposed on the downstream end of retainer 114 and includes a key 225 received in second channel 227 in the base 68 of slot 60. Return spring 110 bears at its downstream end against downstream retainer 114 with its downstream end 120 in engagement with the upstream end of blade 40. The end faces of blade 40 and corresponding retainer 114 and piston 108 are preferably angled to force blade 40 to maintain contact with the side wall load 66 to prevent movement and fretting and thereby preventing wear.

In operation, blades 40, 42 are actuated by a pump (not shown) at the surface. Drilling fluids are pumped down through the drill string and through flowbore 26 and flow tube 44 with the pressure of the drilling fluids acting on the downstream end 106 of extender piston 104. The drilling fluids pass around the lower end of the drilling assembly and flow up annulus 32 to the surface causing a pressure drop. The pressure drop is due to the flowing of the drilling fluid through the bit nozzles and through a downhole motor, in the case of directional drilling, and is not generated by any restriction in the stabilizer 10 itself. The pressure of the drilling fluids flowing through the drill string is therefore greater than the pressure in the annulus 32 thereby creating a pressure differential. The extender piston 104 is responsive to this pressure differential with the pressure differential acting on extender piston 104 and causing it to move upwardly within piston cylinder 72. The extender piston 104 in turn engages the lower terminal end of blade 40 such that once there is a sufficient pressure drop across the bit, piston 104 will force blade 40 upwardly.

As extender piston 104 moves upwardly, blade 40 also moves upwardly axially and cams radially outward on ramps 88, 90 into a loaded position. As blade 40 moves axially upward, the upstream end of blade 40 forces retainer 114 into return cylinder 70 thereby compressing return spring 110. It should be appreciated that the fluid flow (gallons per minute) through the drill string must be great enough to produce a large enough pressure drop for piston 104 to force the stabilizer blade 40 against return spring 110 and compress spring 110 to its collapsed position shown in FIG. 3.

Figure 4C:
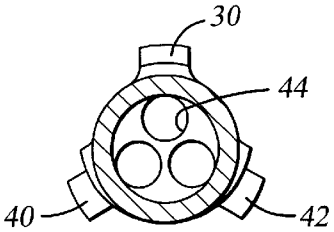
FIG. 4C is a cross-section view taken at plane IX in FIG. 3 showing the downstream end of the stabilizer with the blades in the extended position.
Figure 4B:
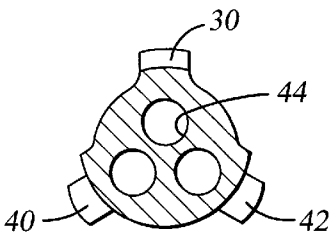
FIG. 4B is a cross-section view taken at plane VIII in FIG. 3 showing the extender pistons in engagement with the blades in the extended position.
Figure 4A:
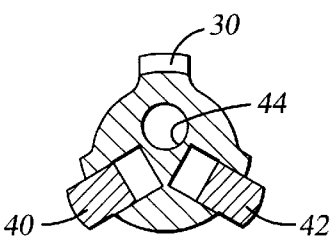
FIG. 4A is a cross-section view taken at plane VII in FIG. 3 showing the adjustable blades in their extended position.

As best shown in FIG. 4A, blades 40, 42 extend in a direction opposite to that of fixed blade 30 in that a component of the direction of blades 40, 42 is in a direction opposite to that of fixed blade 30. Further it can be seen that the axis of adjustable blades 40, 42 is at an angle to the axis of fixed blade 30.

To move blade 40 back to its contracted position shown in FIG. 1, the pump at the surface is turned off and the flow of fluid through the drill string is stopped thereby terminating the pressure differential across extender piston 104. Compressed return spring 110 then forces downstream retainer 114 axially downward against the upstream terminal end of blade 40 causing blade 40 to move downwardly on ramp surfaces 88, 90 and back into slot 60 to a non-loaded position shown in FIG. 1. Gravity will also assist in causing blade 40 to move downwardly.

Blades 40, 42 are individually housed in slots 60, 62 of stabilizer housing 12 and also are actuated by their own individual extender pistons 104 and return springs 110. However, since each is responsive to the differential pressure, adjustable blades 40, 42 will tend to actuate together to either the extended or contracted position. It is preferred that blades 40, 42 actuate simultaneously and not individually.

Referring now to FIGS. 44–46, there is shown an alternative extender piston 139. The flow passageway 201 has an enlarged diameter portion 141 at its downstream end forming an annular shoulder 249. A large nozzle 145 is threadingly mounted at the transition of the enlarged diameter portion 141. An inner seat sleeve 147 is mounted within the enlarged diameter portion 141 and includes a flange 149 which bears against an annular shoulder 151 and is retained by a retaining ring 153. A seal 155 is provided to sealingly engage piston 139. The seat sleeve 147 includes a frustoconical portion forming a seat 157. A spring 143 is mounted against the annular shoulder 249. A stem 159 is extends through the aperture 161 in seat sleeve 147 and has two parts for assembly purposes, namely a spring retainer 163 threaded at 165 to a valve element 167 having a frustoconical portion 169 for mating with the seat 157. Spring retainer 163 bears against the other end of spring 143. Spring 143 is light enough that the pressure drop through the stem 159 will compress the spring 143 and allow the stem 159 to seat and seal on the seat 157. Seals 171 are provided on the valve element 167 for sealingly engaging with the seat 157. The stem 159 includes a restricted passageway 173 therethrough. The stem 159 includes an enlarged bore around the downstream end of passageway 173 for threadingly receiving a smaller nozzle 103. Flow from the filter assembly 121 first passes through the smaller nozzle 103, through the restricted passageway 173 of the stem 159, then through the larger nozzle 145 and into the main flow passageway 201 in the piston 139.

In operation, flow is allowed to continuously pass through the actuator piston 139 to flush out the bottom of the blade slot 60. If for some reason upon turning off the pumps, return spring 110 is unable to fully retract the blade 40 and actuator piston 139 into actuator cylinder 72, as shown in FIG. 46, spring 143 will force the stem 159 downstream and unseat valve element 167 from seat 157 opening up a flow passage 175 around the stem 167 and seat 157 and through flow flutes 177 in spring retainer 163. This flow then passes through the larger nozzle 145 so as to increase the fluid available for flushing out the bottom of the blade slot 60. The flow through the stabilizer 10 can be started and stopped by turning the pump on and off so as to alternate the volume of flow through the actuator cylinder 70 and piston 139 to help dislodge and flush out any cuttings in the blade slot 60. This larger flow will cause an overall reduced pressure drop across the nozzles of the pilot bit due to the reduced flow at the bit.

Further when this reduced pressure drop occurs, it will be noted at the surface and the operator will know that the blades are not fully retracted and that there are cuttings impacted in the blade slot 60. The operator can then turn the pumps on and off to help flush out the cuttings. By turning the pumps on and off, the flow through the slot 60 is varied in an effort to dislodge the cuttings. Also, the larger nozzle 145 allows additional flow through the actuator piston 139 to help dislodge the cuttings. The double nozzle provides a tell-tale to allow the operator to know when the blades are not fully collapsing all the way into the slot 60.

Figure 47:
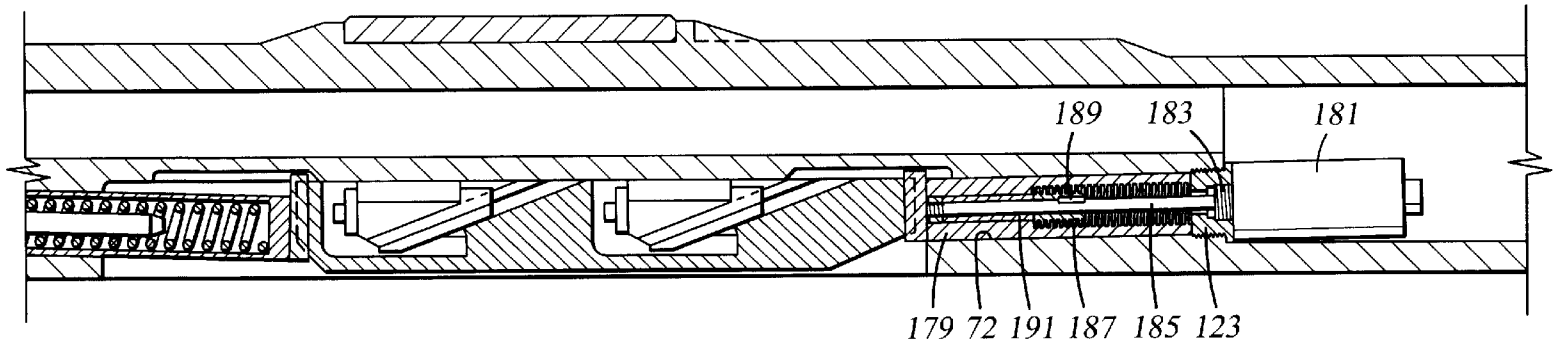
FIG. 47 is cross-section elevation view of an alternative actuator in the contracted position for the eccentric adjustable diameter blade stabilizer of FIG. 1.
Figure 48:
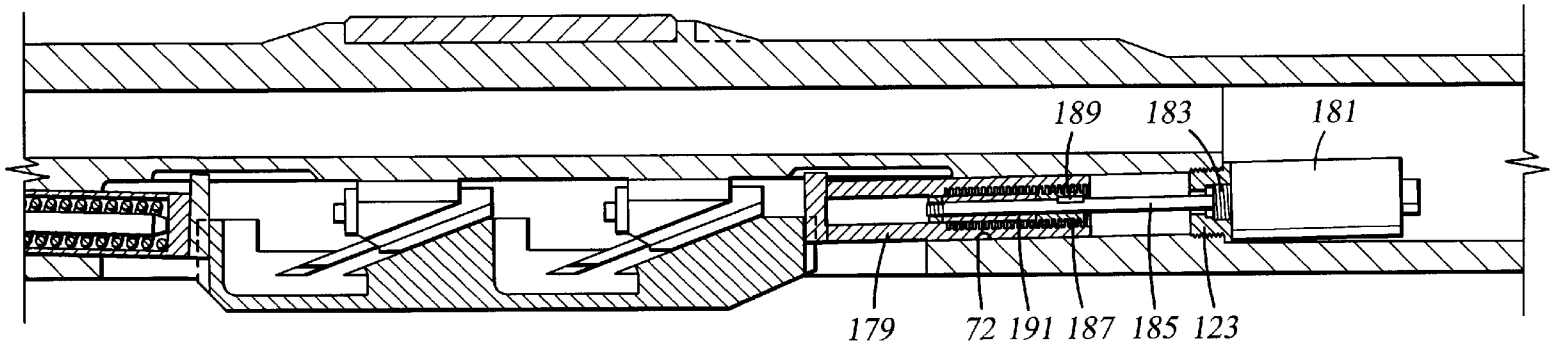
FIG. 48 is cross-section elevation view of the actuator of FIG. 47 in the extended position.

Referring now to FIGS. 47 and 48, there is shown an alternative apparatus and method for actuating the blades of the stabilizer. An actuator piston 179 is housed within the cylinder 72 and is connected to an electric motor 181. Motor 181 has a housing with a threaded post 183 for threading engagement with retainer nut 123. Motor 181 includes an output shaft 185 having a gear 187 mounted thereon. Gear 187 and output shaft 185 have aligned slots for receiving a key 189 for preventing rotating of the gear 187 relative to the output shaft 185. A spacer 191 is passed over the end of the output shaft 185 and engages one end of the gear 187 and then a nut is threaded into the output shaft 187 to cause the spacer 191 to bias the gear 187 against the key 189 to hold the gear 187 in place. It should be appreciated that a second spacer sleeve could be disposed between the motor housing and the inside of the gear. The actuator piston 179 has a threaded bore 191 threadingly receiving gear 187. In operation, upon rotating the output shaft 185, the gear 187 causes the actuator piston 179 to reciprocate within cylinder 72 and thus move the blade 40.

It is preferable for the actuator piston 179 and electric motor 181 to be located in the upper end of the stabilizer. By putting the motor upstream, a retractor is no longer necessary. The motor 181 would not only actuate but also retract the blade 60.

It should be appreciated that the blades could also be actuated by placing weight on the bit. As weight is placed on the bit, a mandrel moves upwardly causing the blades to cam outwardly. The stabilizer manufactured by Andergauge is actuated in this fashion.

It should be appreciated that the control section described in U.S. Pat. No. 5,318,137, incorporated by reference, may be adapted for use with stabilizer 10 of the present invention whereby an adjustable stop, controlled from the surface, may adjustably limit the upward axial movement of blades 40, 42 thereby limiting the radial movement of blades 40, 42 on ramps 88, 90 as desired. The adjustable stop engages the upstream terminal end of blade 40 to stop its upward axial movement on ramps 88, 90, thus limiting the radial stroke of the blade. Limiting the axial travel of blades 40, 42 limits their radial extension. The positioning of the adjustable stop may be responsive to commands from the surface such that blades 40, 42 may be multi-positional and extend or retract to a number of different radial distances on command.

It should also be appreciated that a mechanism may be used to lock blades 40, 42 in the contracted position upon retrieval from the borehole. One method includes having a small nozzle in each extender piston so that a low flow rate of less than 300 GPM will not move against reactor spring but will flush cuttings from underneath blades that may have gotten impacted. If the blades do not retract completely, the top angle is designed to load against the start of the bottom of the cased section of borehole such that loading is in the direction that the blades would move along ramps to be the contracted position. Blades move to the fully contracted position at least once every joint of drill pipe length drilled because pumps are turned off to connect the next joint of pipe to the drill string. This action flushes out cuttings that may have settled.

Referring now to FIGS. 5–8, there is shown a schematic alternative embodiment of the eccentric adjustable diameter blade stabilizer of the present invention. Eccentric adjustable diameter blade stabilizer 120 replaces the fixed blade 30 of the preferred embodiment of FIGS. 1–4 with a third adjustable blade 122. The other two adjustable blades are of like construction and operation as adjustable stabilizer blades 40, 42 of the preferred embodiment of FIGS. 1–4. Because of the third adjustable blade 122, the diameter 124 of housing 126 is smaller than diameter 14 of the preferred embodiment of FIGS. 1–4. Diameter 124 is smaller because the flow tube 128 passing through housing 126 must be positioned more interiorally than that of flow tube 44 of the preferred embodiment. Flow tube 44 of the preferred embodiment is located on one side of housing axis 17 while the housing axis 130 of stabilizer 120 passes through flow tube 128. This causes the width 132 of blades 40, 42 to be slightly smaller than the width 96 of the blades of the preferred embodiment. The range of travel in the radial direction by the third adjustable blade 122 is also less than that of the other two adjustable blades 40, 42. The slot 134 which houses the third adjustable blade 122 includes a pair of cam members 136, 138 having inclined surfaces or ramps 140, 142, respectively, which are integral to housing 126. The third adjustable blade 122 also includes notches 144, 146 forming incline surfaces or ramps 148, 150. The angle of ramps 140, 148 and 142, 150 have a smaller angle with respect to axis 130 such that upon axial movement of the third adjustable blade 122, third blade 122 does not move radially outward as far as blades 40, 42 due to the reduced angle of the ramps. It should also be appreciated that the width 152 of the third adjustable blade 122 is smaller than that of the width 132 of blades 40, 42. The third adjustable blade 122 is considered the top blade and is preferably aligned with the reamer section of the bi-center bit as hereinafter described.

Referring now to FIGS. 9–12, there is shown a still further alternative embodiment of the eccentric adjustable diameter blade stabilizer of the present invention. Although the preferred embodiment of FIGS. 1–4 describes the stabilizer as including two adjustable blades and the alternative embodiment of FIGS. 5–8 describe the stabilizer as having three adjustable blades, it should be appreciated that the eccentric adjustable diameter blade stabilizer of the present invention may only include one adjustable blade. The single adjustable blade 154 of stabilizer 160 is disposed within a slot 156 in housing 158. Individual blade 154 is comparable in structure and operation to that of adjustable blades 40, 42 shown and described with respect to the preferred embodiment of FIGS. 1–4. It should be appreciated, however, that because only one adjustable blade is disposed within housing 158, that the width 162 of blade 154 may be greater than that of blades 40, 42 of the preferred embodiment. Although the flow tube 44 of stabilizer 160 is similar in structure and placement as the flow tube of the preferred embodiment, the elimination of the second adjustable blade provides a greater interior area of housing 158 so as to provide a larger slot 156 within which to house individual adjustable blade 154.

Referring now to FIGS. 13–16, there is shown an alternative embodiment of the contact members, i.e. the blades shown in FIGS. 1–12. The blades shown in FIGS. 1–12 are generally elongated planar members extending axially in slots in the housing of the stabilizer. The contact members of the alternative embodiment shown in FIGS. 13–16 include one or more cylinders or buttons 164, 166 disposed within the housing 168 of stabilizer 170. It is preferred that buttons 164, 166 are aligned in a common plane with housing axis 172. One means of actuating buttons 164, 166 includes a spring 174 disposed between an annular flange 176 adjacent the bottom face 178 of buttons 164, 166 and a retainer member 180 threadably engaged with housing 168.

In operation, when the pumps are turned on at the surface, drilling fluid flows through flow tube 44 applying pressure to the bottom face 178 of buttons 164, 166. The differential pressure between the flow bore 26 and the annulus 32 formed by the borehole 34, as previously described, causes cylinders 164, 166 to move radially outward due to the pressure differential. The return springs 174 are compressed such that upon turning off the pumps, the springs 174 return buttons 164, 166 to their contracted position shown in FIG. 13. It should be appreciated that the outer surface 182 of buttons 164, 166 may have a beveled or tapered leading and trailing edge. It should also be appreciated that the bottom face 178 of buttons 164, 166 can be arranged to be flush with the inner wall of flow tube 44 so as to achieve a maximum width for buttons 164, 166. This also allows the maximization of the stroke of buttons 164, 166. Further, it should be appreciated that buttons 164, 166 may be locked in their radial extended position. Although one means of actuating buttons 164, 166 has been described, it should be appreciated that buttons 164, 166 may be actuated similar to that described and used for the adjustable concentric blade stabilizer manufactured and sold by Andergauge. The Andergauge brochure is incorporated herein by reference.

It should be appreciated that the eccentric adjustable diameter blade stabilizers described in FIGS. 1–16 may be used in many different drilling assemblies for rotary drilling and in many different bottom hole assemblies for directional drilling. The following describes some of the representative assemblies with which the present invention may be used and should not be considered as the only assemblies for which the stabilizer of the present invention may be used. The eccentric adjustable diameter blade stabilizer may be used in any assembly requiring a stabilizer which acts as a pivot or fulcrum for the bit or which maintains the drilling of the bit on center.

Referring now to FIGS. 17–22, there is shown a rotary assembly 200 including a bi-center bit 202, the eccentric adjustable diameter blade stabilizer 10, one or more drill collars 16, and a fixed blade stabilizer 204. Although the following assemblies will be described using the eccentric adjustable diameter blade stabilizer 10 of the preferred embodiment, it should be appreciated that any of the alternative embodiments may also be used. The stabilizer 10 is located adjacent to and just above the bi-center bit 202. The bi-center bit 202 includes a pilot bit 206 followed by an eccentric reamer section 208. The fixed blade 30 and adjustable blades 40, 42 are located preferably two to three feet above the reamer section 208 of bi-center bit 202. The fixed blade stabilizer 204 is preferably located approximately 30 feet above bi-center bit 202.

Figure 17:
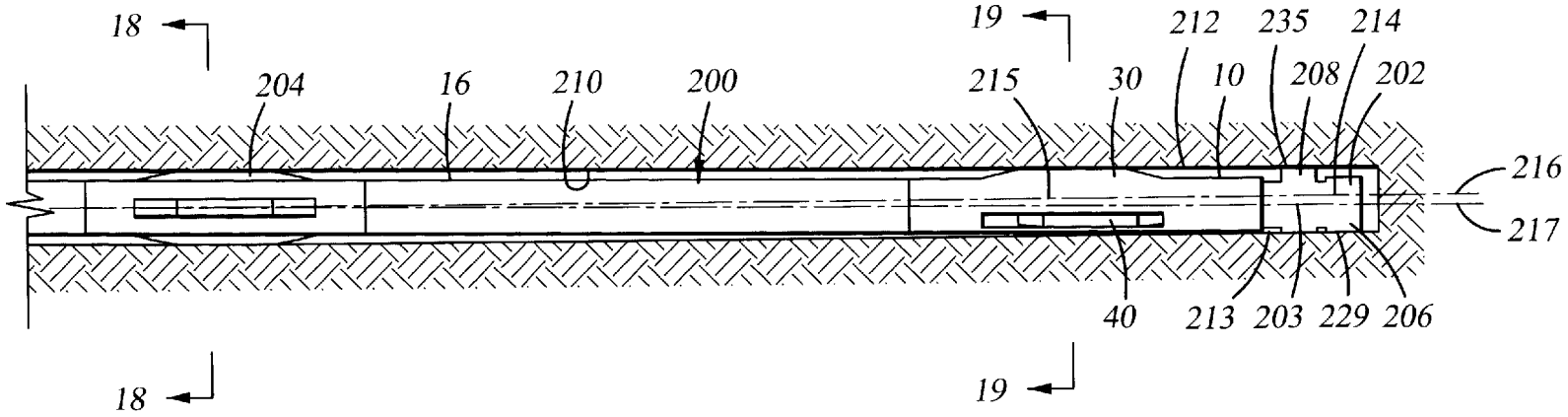
FIG. 17 is a diagrammatic elevation view showing a rotary drilling assembly with a bi-center bit, the stabilizer of FIGS. 1–4, drill collars, and an upper fixed blade stabilizer.
Figure 18:
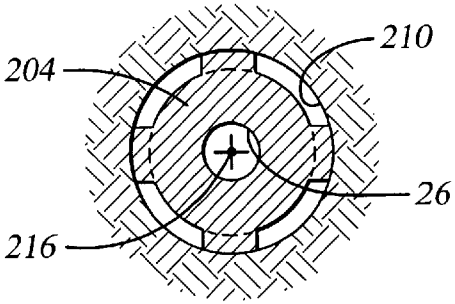
FIG. 18 is a cross-section view taken at plane 18 in FIG. 17 showing the fixed blade stabilizer in an existing cased borehole.
Figure 49:
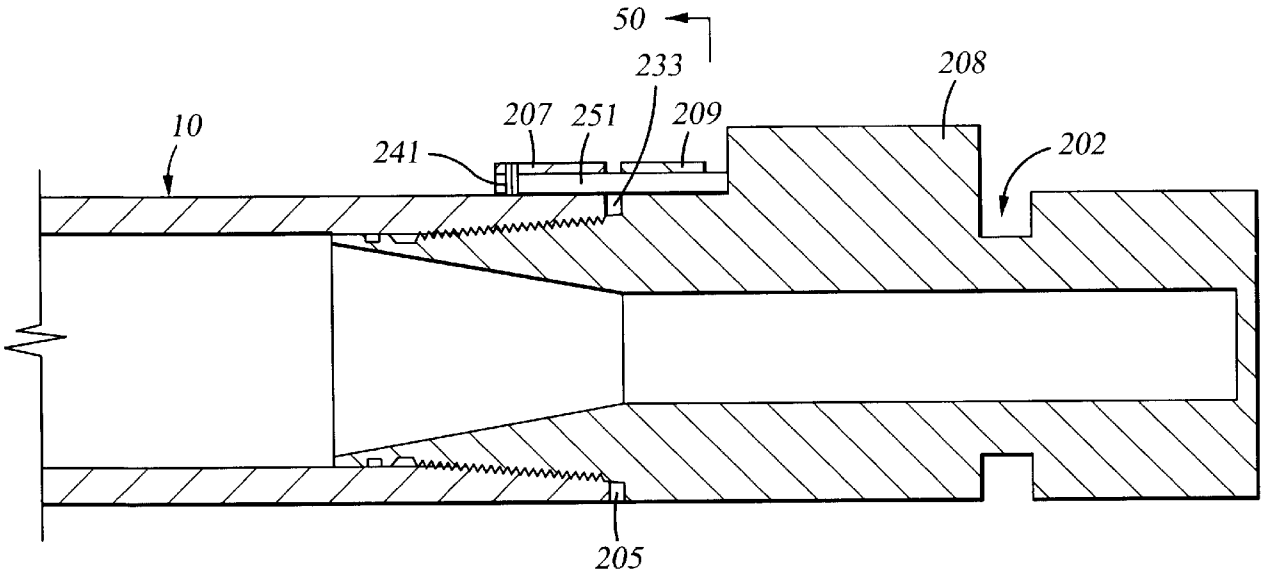
FIG. 49 is a cross-section view of the alignment members for the connection between the eccentric adjustable diameter blade stabilizer and bi-center bit.
Figure 50:
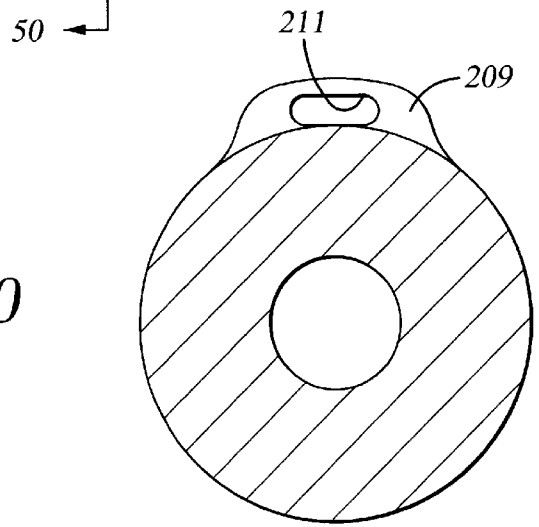
FIG. 50 is a cross-section taken at plane 50—50 in FIG. 49 of the alignment member.

FIGS. 17–19 and 49–50 illustrate the rotary drilling assembly 200 passing through an existing cased borehole 210 having an axis 211, best shown in FIG. 18. As best shown in FIG. 17, fixed blade 30 is aligned with eccentric reamer section 208 such that fixed blade 30 and reamer section 208 are in a common plane to engage one side 212 of the wall 209 of existing cased borehole 210 along a common axial line thereby causing the other side of pilot bit 206 to engage the opposite side 213 of existing cased borehole 210. Referring now to FIG. 49 and 50, the rotary shouldered connection between the bi-center bit 202 and the eccentric stabilizer 10 are timed circumferencially by a spacer 233 at the torque shoulder 205, the width of the spacer 233 being adjusted as required. The bi-center bit 202 and the stabilizer 10 have an extended member 209, 207, respectively, in the direction of the reamer section 208 and fixed pad (not shown), respectively, with a slot 211 shaped to accept a shear member 251. The shear pin is held in place by a bolt or spring pin 241. The threading of the bi-center bit 202 onto the stabilizer 10 is torqued to a specific degree. Such that when that torque is reached, the slots 211 of the flange members 207, 209 line up axially at the proper connection makeup torque so that the shear bolt member 213 can be inserted through both slots 211 simultaneously to fix the relative rotation between the bit 202 and stabilizer 10 so that the fixed pad and reamer section 208 are permanently aligned axially. Upon assembly, fixed blade 30 is aligned with the reamer section 208 of the bi-center bit 202. This alignment allows the drilling assembly to pass through the existing cased borehole 34. Fixed blade 30 can be likened to an extension of the reamer section 208 of the bi-center bit 202.

Figure 19:
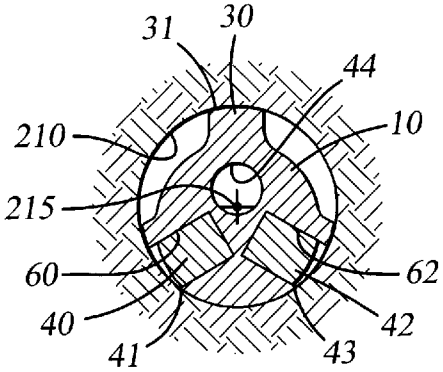
FIG. 19 is a cross-section view taken at plane 19 in FIG. 17 showing the adjustable blade stabilizer in the contracted position.

The pass-through diameter of existing cased borehole 210 is that diameter which will allow the drilling assembly 200 to pass through borehole 210. Typically the pass-through diameter is approximately the same as the diameter of the existing cased borehole and has a common axis 216. As best shown in FIG. 19, adjustable blades 40, 42 are in their collapsed or contracted position in slots 60, 62 with blades 30, 40, and 42 having circumferential contact areas 31, 41, and 43, respectively, engaging the inner surface of wall 209 of existing cased borehole 210. The fixed blade 30 and two adjustable blades 40, 42 provide three areas of contact with the wall 209 of the borehole approximately 120° apart. The three contact areas 31, 41, and 43 form a contact axis or center 215 which is coincident with the axis 216 of the pass-through diameter and with the bit axis or center 214 of bi-center bit 202. The center 214 of bi-center bit 202 is equidistant between the cutting face 235 of reamer section 208 and the opposite cutting side 229 of pilot bit 206. With pass-through axis 216, contact axis 215 and bit axis 214 being coincident, no deflection is required between stabilizer 10 and bi-center bit 202 to pass the drilling assembly 200 through the existing cased borehole 210. As shown in FIG. 17, the axis 217 of drilling assembly 200 is on center with axis 216 of cased borehole 210 at upper fixed blade stabilizer 204 but is deflected by fixed blade 30 and reamer section 208 at the bottom of the drilling assembly 200 as shown by the center 203 of pilot bit 206. This deflection require that the upper fixed blade stabilizer 204 be located approximately 30 feet away from bi-center bit 202.

Figure 20:
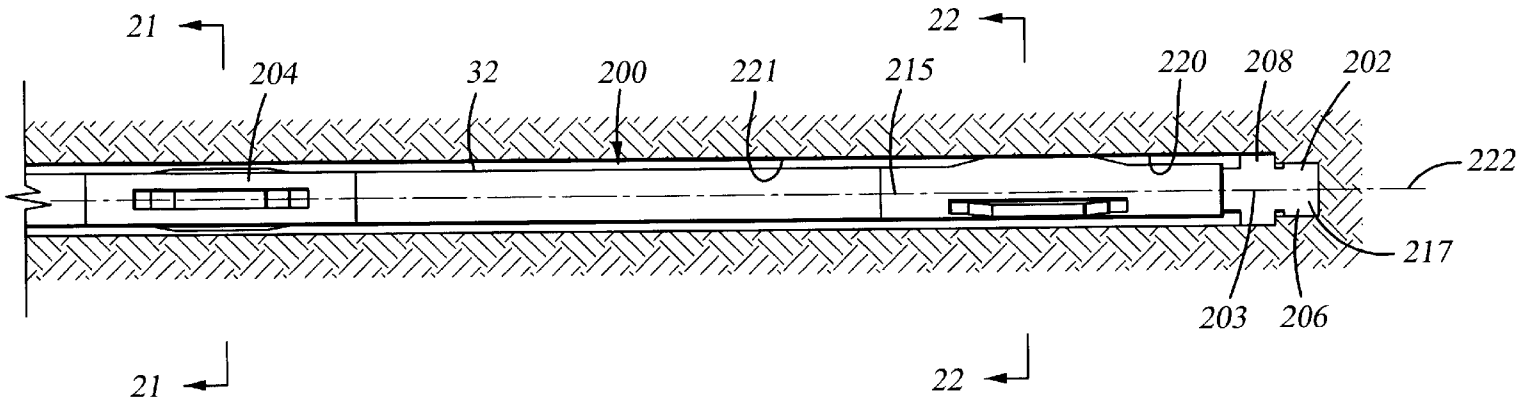
FIG. 20 is a diagrammatic elevation view of the drilling assembly shown in FIG. 17 with the adjustable blades in the extended position and the drilling assembly in the new borehole.
Figure 22:
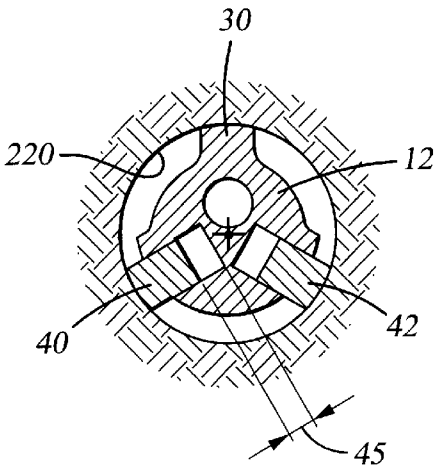
FIG. 22 is a cross-section view taken at plane 22 in FIG. 20 showing the adjustable blades in the extended position contacting the wall of the new borehole.
Figure 21:
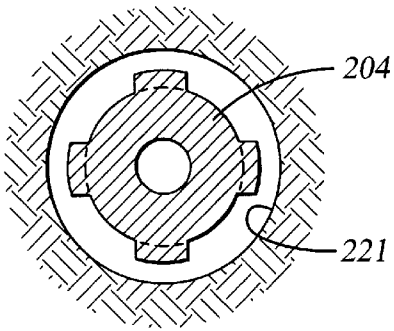
FIG. 21 is a cross-section view taken at plane 21 in FIG. 20 showing the positioning of the fixed blade stabilizer in the new borehole.

Referring now to FIGS. 20–22, rotary drilling assembly 200 is shown drilling a new borehole 220. The adjustable blades 40, 42 have been actuated to their extended position due to the pressure differential between the interior and exterior of stabilizer housing 12. As best shown in FIG. 22, the extended blades 40, 42 shift the contact axis 215 from the position shown in FIG. 19 to the position shown in FIG. 22. As best shown in FIG. 20, contact axis 215 is now coincident with the axis 217 of drilling assembly 200 and is also coincident with the axis 222 of new borehole 220 and most importantly with the axis 203 of pilot bit 206. The three areas of contact 31, 41, and 43 of blades 30, 40, and 42 at approximately 120° intervals with the inner surface of wall 221 of new borehole 220 close to pilot bit 206 stabilizes pilot bit 206 and causes pilot bit 206 to drill on center, i.e. with axes 217 and 222 coincident. As best shown in FIG. 22, blades 40, 42 stroke radially outward a distance or radial extent 45 which is required to properly shift the contact axis 215 from the pass-through mode shown in FIG. 17 to the drilling mode for the new borehole 220 shown in FIG. 20. Reamer section 208, following pilot bit 206, enlarges borehole 220 as it rotates in eccentric fashion around the axis of rotation 217. Because the diameter of new borehole 220 is greater than the diameter of cased borehole 210, the blades of fixed blade stabilizer 204 do not simultaneously contact the wall 221 of new borehole 220 as shown in FIG. 21.

The drilling assembly 200 shown in FIGS. 17–22 cause the eccentric adjustable diameter blade stabilizer 10 to become a near bit stabilizer. A near bit stabilizer must be undergauge in order to have a full range of control when the adjustable blades 40, 42 are either in their extended or contracted positions. The amount of undergauge is determined by the length of the stroke 45 desired for the adjustable stabilizer blades 40, 42. For example, if the housing 12 of stabilizer 10 is ⅛ to ¼ inch undergauge, the travel of adjustable blades 40, 42 must be adjusted accordingly. This travel adjustment must be made prior to running the drilling assembly 200 into the well. The travel 45 of adjustable blades 40, 42 is adjusted by limiting the stroke of the blades, radial movement of blades 40, 42 stops as their travel on ramps 78, 80 is stopped. Stroke is limited by the dowel 133. Stroke is adjusted by adjusting the length of dowel 133 such as by adding or deleting washers at the shoulder of threaded end 223.

Figure 23:
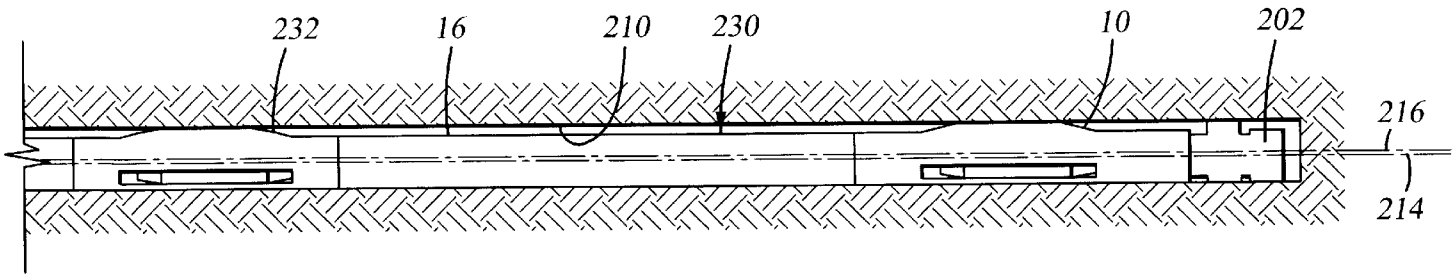
FIG. 23 is a diagrammatic elevation view of another embodiment of the drilling assembly of FIGS. 17–23 showing an upper eccentric adjustable diameter blade stabilizer of the present invention as the upper stabilizer and in the contracted position in an existing cased borehole.
Figure 26:
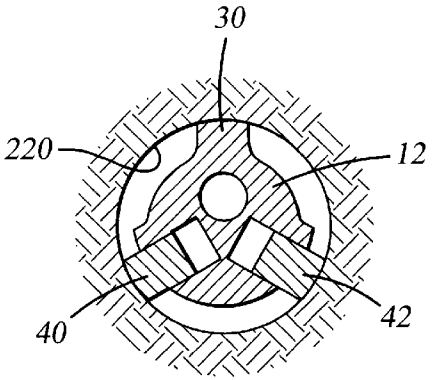
FIG. 26 is a cross-section view taken at plane 26 in FIG. 25 showing the adjustable blades in the extended position.
Figure 24:
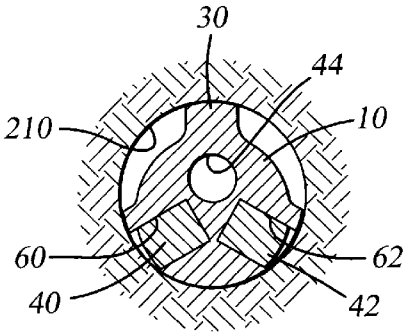
FIG. 24 is a cross-section view taken at plane 24 in FIG. 23 showing the upper eccentric adjustable diameter blade stabilizer in the contracted position.
Figure 25:
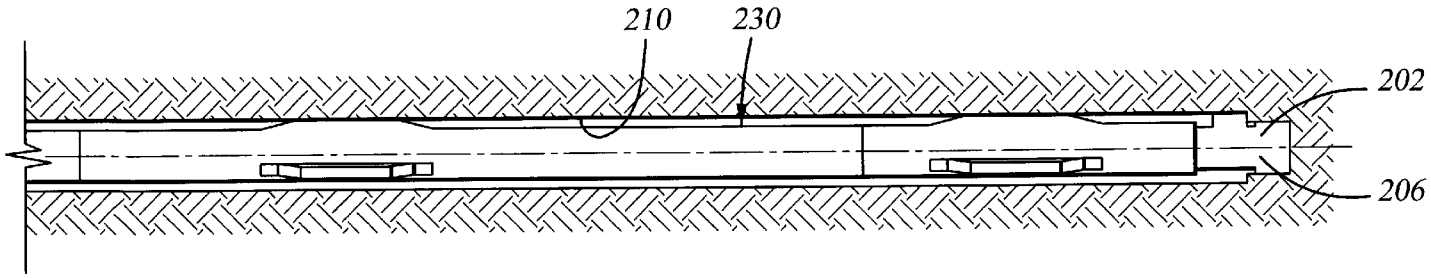
FIG. 25 is a diagrammatic elevation view showing the drilling assembly of FIG. 23 with the adjustable blades of the upper and lower stabilizers in the extended position.
Figure 27:
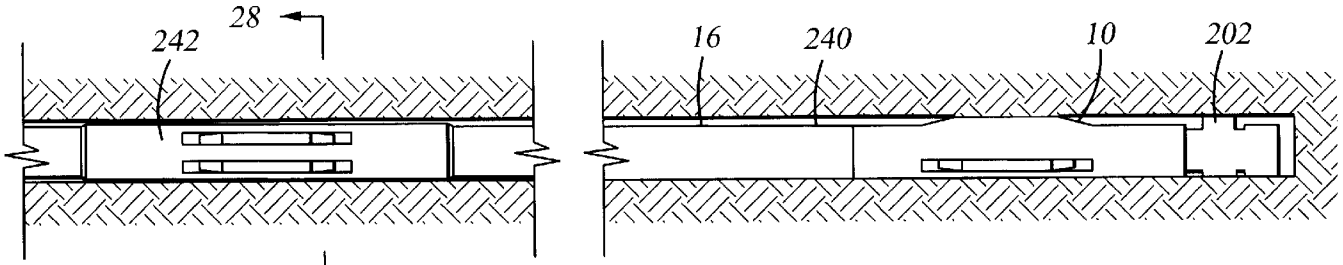
FIG. 27 is a diagrammatic elevation view showing a still another embodiment of the drilling assembly of FIGS. 17–22 with an adjustable concentric stabilizer as the upper stabilizer and in the contracted position in a cased borehole.
Figure 28:
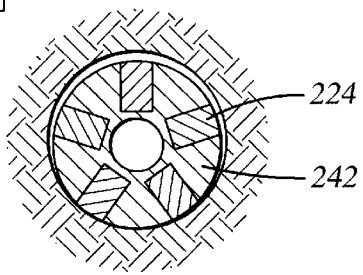
FIG. 28 is a cross-section view taken at plane 28 in FIG. 27 showing the adjustable blades of the adjustable concentric stabilizer in the contracted position.
Figure 29:
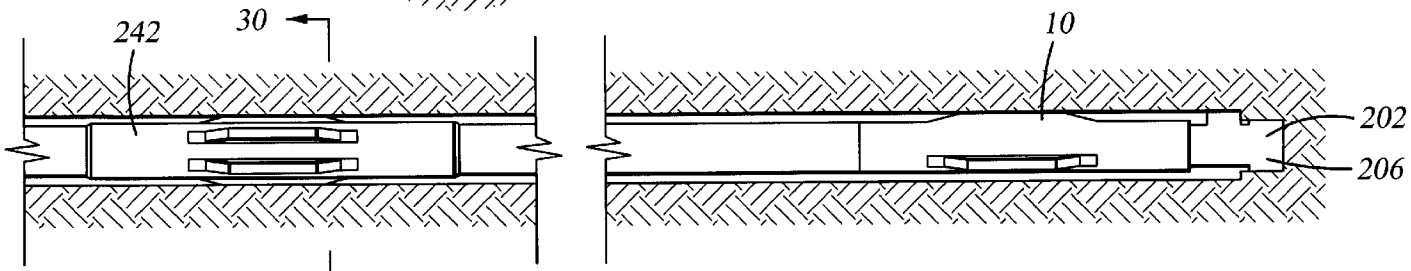
FIG. 29 is a diagrammatic elevation view showing the drilling assembly of FIG. 27 with the adjustable blades of the two stabilizers in the extended position.
Figure 30:
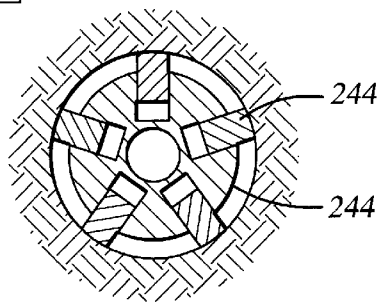
FIG. 30 is a cross-section view taken at plane 30 in FIG. 29 showing the adjustable blades of the adjustable concentric stabilizer in the extended position.

Referring now to FIGS. 23–26, there is shown a packed hole assembly 230 including a bi-center bit 202, a lower eccentric adjustable diameter blade stabilizer 10, a plurality of drill collars 16 and an upper eccentric adjustable blade stabilizer 232 substantially the same as that of lower stabilizer 10. Lower stabilizer 10 is mounted just above bi-center bit 202 as described with respect to FIGS. 17–22 and the upper eccentric adjustable diameter blade stabilizer 232 is approximately 15 to 20 feet above lower eccentric adjustable diameter blade stabilizer 10, best shown in FIG. 23. By having adjustable blades on upper stabilizer 232, the upper stabilizer 232 may be located closer to lower stabilizer 10 because the pass-through diameter of the upper stabilizer 232 is less than that of the fixed blade stabilizer 204 shown in the embodiment of FIGS. 17–22. With a smaller pass-through diameter, the deflection of the assembly 230 is reduced during pass-through of the existing cased borehole 210. As shown in FIG. 23, the fixed blades 30 of upper and lower stabilizers 232, 10 allow the axis 217 of the packed hole assembly 230 to be substantially parallel to the axis 216 of the cased borehole 210. Further, as best shown in FIG. 26, blades 30, 40, 42 will engage the wall of new borehole 220 whereas the fixed blades of stabilizer 204 shown in the embodiment of FIGS. 17–22 do not simultaneously engage the wall of new borehole 220. Thus, by utilizing the upper adjustable blade stabilizer 232, the packed hole drilling assembly 230 becomes more stable in allowing pilot bit 206 to drill a straight hole.

Referring now to FIGS. 27–30, there is shown another embodiment of the packed hole assembly. The packed hole assembly 240 includes bi-center bit 202, eccentric adjustable diameter blade stabilizer 10, drill collars 16, and an adjustable concentric stabilizer 242 approximately 30 feet above bi-center bit 202. Adjustable concentric stabilizer 242 may be the TRACS stabilizer manufactured by Halliburton. The TRACS adjustable concentric stabilizer provides multiple positions of the adjustable blades 244 which permit the pilot bit 206 to drill at an inclination using lower stabilizer 10 as a fulcrum. It should be appreciated that the stroke 45 of blades 40, 42 may be reduced to produce a radius for contact axis 215 which is, for example, ¼ inch undergauge such that the concentric adjustable stabilizer 242 would permit a drop angle.

Figure 31:
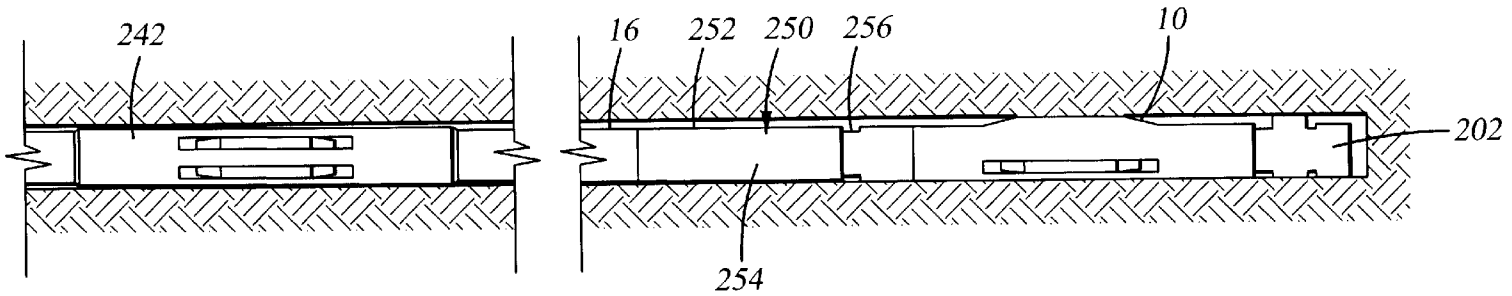
FIG. 31 is a diagrammatic elevation view of a bottom hole assembly for directional drilling including a bi-center bit and eccentric adjustable diameter blade stabilizer mounted on the output shaft of a down hole drilling motor with an adjustable concentric stabilizer above the motor, all in a cased borehole with the blades of the stabilizers in the contracted position.
Figure 32:
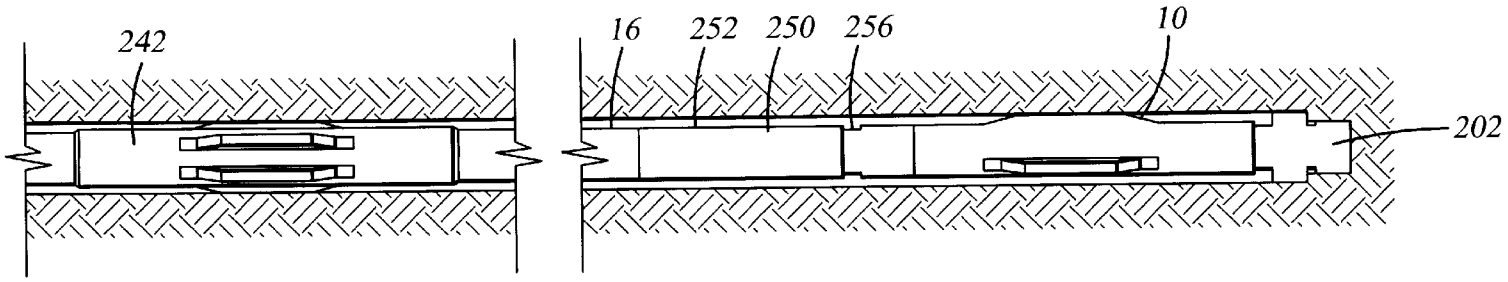
FIG. 32 is a diagrammatic elevation view of the bottom hole assembly of FIG. 31 with the blades of the two stabilizers in the extended position.

Referring now to FIGS. 31 and 32, there is shown a bottom hole assembly 250 for directional drilling. Bottom hole assembly 250 includes a downhole drilling motor 252, which may be a steerable and have a bend at 254. Downhole motor 252 includes an output shaft 256 to which is mounted the eccentric adjustable diameter blade stabilizer 10. One or more drill collars 16 are mounted to the housing of steerable motor 252 and extend upstream for attachment to upper adjustable concentric stabilizer 242. It should be appreciated that downhole motor 252 may or may not include a bend and may or may not have a stabilizer mounted on its housing. The eccentric adjustable diameter blade stabilizer 10 rotates with bi-center bit 202. Thus, stabilizer 10 rotates in both the rotary mode and in the slide mode of bottom hole assembly 250. Lower stabilizer 10 acts as pivot point or fulcrum for bi-center bit 202 as the blades of stabilizer 242 are radially adjusted.

Figure 33:
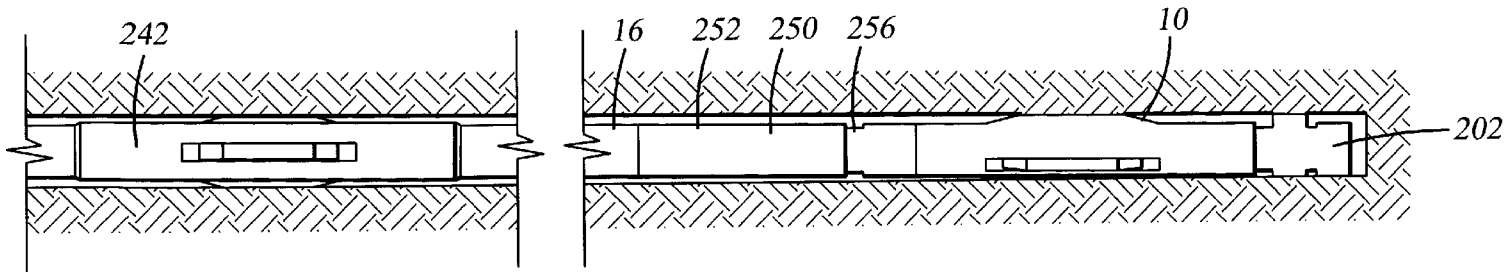
FIG. 33 is a diagrammatic elevation view of a bottom hole assembly like that of FIG. 31 with a fixed blade stabilizer as the upper stabilizer.
Figure 34:
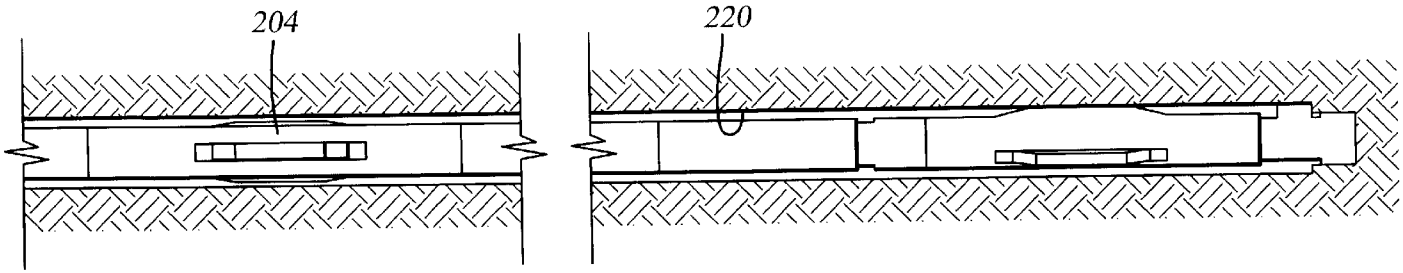
FIG. 34 is a diagrammatic elevation view of the bottom hole assembly of FIG. 33 with the adjustable blades of the lower eccentric adjustable diameter blade stabilizer in the extended position.
Figure 35:
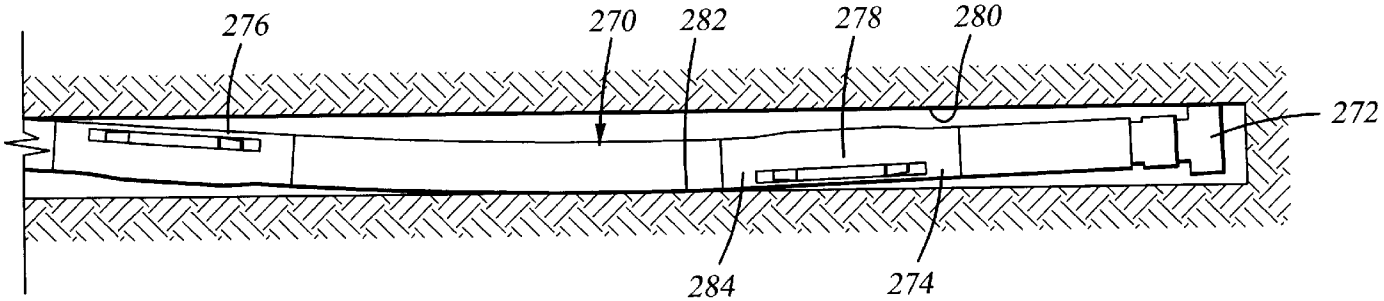
FIG. 35 is a diagrammatic elevation view of another embodiment of the bottom hole assembly using a conventional drill bit with a lower eccentric adjustable diameter blade stabilizer mounted on the housing of a down-hole steerable drilling motor and with an upper eccentric adjustable diameter blade stabilizer mounted above the motor, shown as the bottom hole assembly passes through an existing cased borehole.
Figure 36:
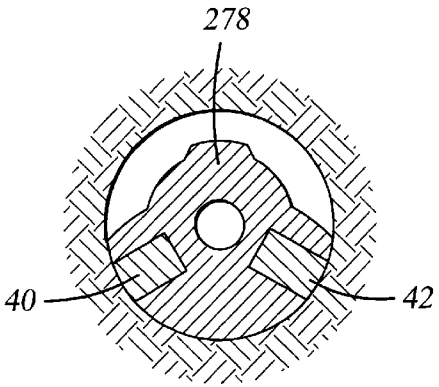
FIG. 36 is a cross-section view taken at plane 36 in FIG. 35 showing the stabilizer in the contracted position.

Referring now to FIGS. 33 and 34, the bottom hole assembly 260 may be the same as that shown in FIGS. 31 and 32 with the exception that a fixed blade stabilizer 204 may be used in place of an adjustable concentric stabilizer. However, for reasons previously discussed, typically, the use of a fixed blade stabilizer as the upper stabilizer in the bottom hole assembly is less preferred since the fixed blades do not engage the wall of the new borehole 220 such as is illustrated in FIG. 21.

Although the drilling assemblies have been described using the preferred embodiment of the eccentric adjustable diameter blade stabilizer shown in FIGS. 1–4 with an upper fixed blade, it should be appreciated that the alternative embodiments of FIGS. 5–8, FIGS. 9–12, and FIGS. 13–16 may also be used in these drilling assemblies. For example, referring to FIGS. 58, the third adjustable blade 122 may replace the fixed blade 30 and still provide the requisite contact area at 123 with the borehole and provide the requisite contact axis 215. As best shown in FIG. 8, the contact axis 215 is seen shifted for drilling the new borehole. Also, as shown in FIGS. 9–12, that side of housing 158 opposite adjustable blade 154 may contact the borehole wall and provide the requisite contact area and contact axis 215. Similarly is the case with the embodiment of FIGS. 13–16.

Although the eccentric adjustable diameter blade stabilizer of the present invention is most useful in a drilling assembly with a bi-center bit, the present invention may be used with other drilling assemblies having a standard drill bit. The following are a few examples of drilling assemblies which may use the eccentric adjustable diameter blade stabilizer of the present invention.

The present invention is not limited to a near bit stabilizer. The stabilizer of the present invention can also be a "string" stabilizer. In such a situation, the eccentric adjustable blade stabilizer is mounted on the drill string more than 30 feet above the lower end of the bottom hole assembly. In certain rotary assemblies, the eccentric adjustable blade stabilizer is located 10 feet or more above the conventional bit. The eccentric adjustable blade stabilizer in such a situation replaces the concentric adjustable blade stabilizer which typically is located approximately 15 feet above the conventional bit.

Figure 37:
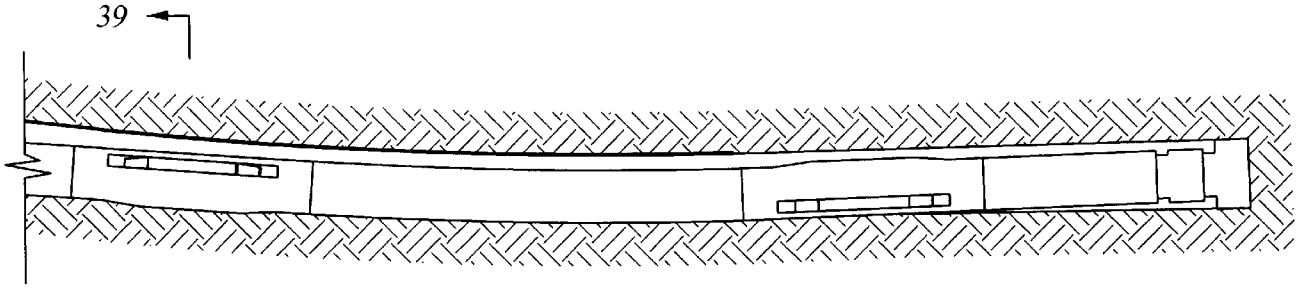
FIG. 37 is a diagrammatic elevation view of the bottom hole assembly of FIG. 35 showing the bottom hole assembly drilling a new borehole which is straight.
Figure 38:
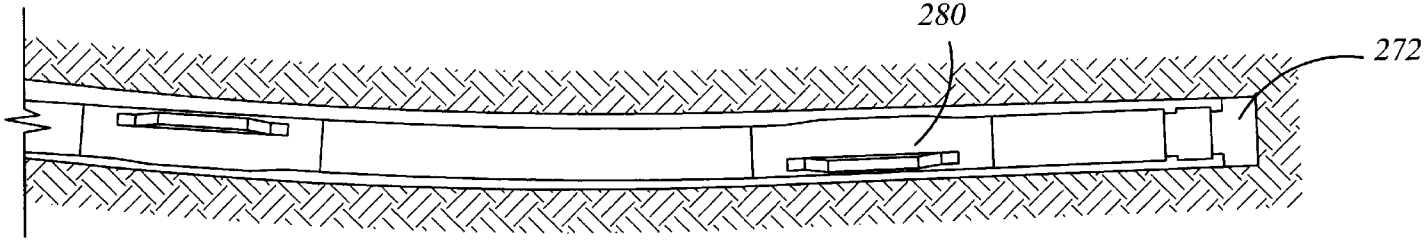
FIG. 38 is a diagrammatic elevation view of the bottom hole assembly of FIGS. 35 and 37 showing the eccentric adjustable diameter blade stabilizer with the adjustable blades in the extended position and causing the bit to gain drill angle.
Figure 39:
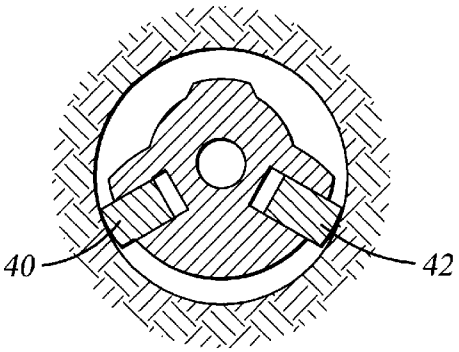
FIG. 39 is a cross-section view taken at plane 39 in FIG. 37 showing the adjustable stabilizer blades in the extended position.
Figure 40:
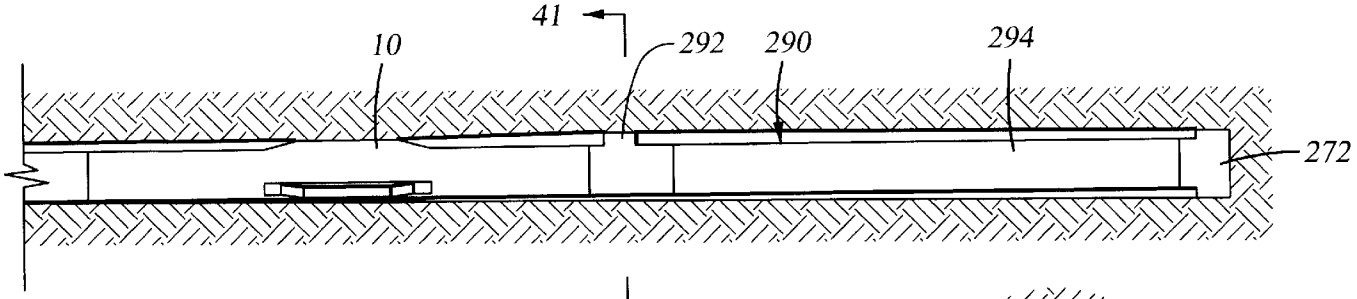
FIG. 40 is a diagrammatic elevation view of a still another embodiment of the drilling assembly having a standard drill bit with a winged reamer upstream of the bit and an eccentric adjustable diameter blade stabilizer mounted above the winged reamer with the blades in the contracted position as the assembly passes through an existing cased borehole.
Figure 41:
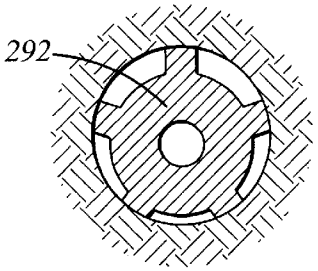
FIG. 41 is a cross-section view taken at plane 41 in FIG. 40 showing the winged reamer.
Figure 42:
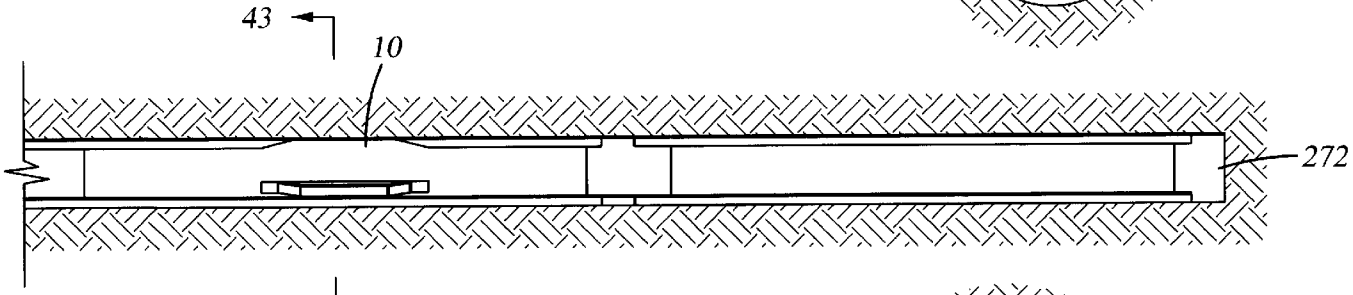
FIG. 42 is a diagrammatic elevation view of the drilling assembly of FIG. 40 showing the adjustable blades in the extended position.
Figure 43:
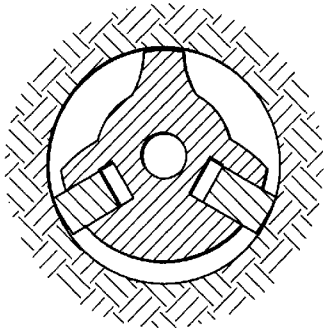
FIG. 43 is a cross-section view taken at plane 43 of FIG. 42 showing the adjustable blades in the extended position.

Referring now to FIGS. 35–39, there is shown a bottom hole assembly 270 which includes a conventional drilling bit 272 mounted on the downstream end of a steerable motor 274. An eccentric adjustable diameter blade stabilizer 278 is shown mounted on the housing 284 of motor 274 adjacent drilling bit 272. An upper eccentric adjustable diameter blade stabilizer 276 is mounted on the upstream terminal end of steerable motor 274. Stabilizers 276, 278 are slightly modified from the preferred embodiment shown in FIGS. 1–4. Stabilizers 276, 278 include adjustable blades 40, 42 but do not have or require an upper blade at 278. No upper blade is provided on stabilizer 276, 278 to allow bottom hole assembly 270 to be used to drill boreholes having a medium radius curvature. Because of eccentric adjustable stabilizer 278, the bend at 282 in motor 274 may be reduced. Adjustable blades 40, 42 on stabilizer 278 act as a pad against the wall of the new borehole 280 for directing the inclination of bit 272. FIG. 37 illustrates blades 40, 42 in the contracted position shown in FIG. 36. This allows bit 272 to drill a straight hole. FIG. 38 illustrates adjustable blades 40, 42 in the extended position causing stabilizer 278 to act like a pad on a steerable motor thereby causing bit 272 to increase hole angle. A tangent of the straight section of steerable motor 274 is drilled when blades 40, 42 are in the contracted position. Stabilizers 276, 278 are timed with the tool face of the steerable motor 274 so that blades 40, 42 are opposite to or in the direction of the hole curvature. Extending blades 40, 42 increases the radius of the curvature of the new borehole 280. The adjustable blades 40, 42 on top of upstream stabilizer 276 push off the wall of the borehole 280 to increase hole curvature. It should also be appreciated that upper stabilizer 276 may be an adjustable concentric multi-positional stabilizer.

Figure 51:
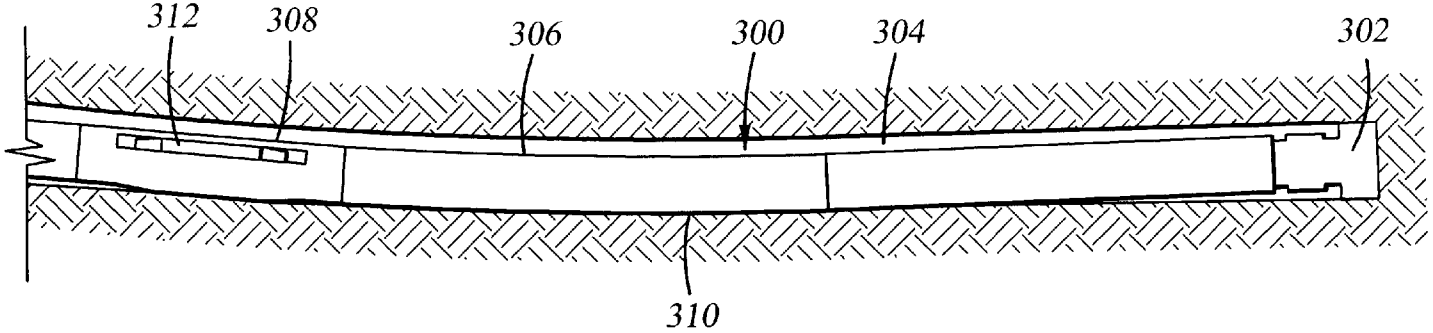
FIG. 51 is a diagrammatic elevation view of a further embodiment of the drilling assembly having a standard drill bit and an eccentric adjustable diameter blade stabilizer mounted above the bent sub and steerable motor.

Referring now to FIG. 51, there is shown a bottom hole assembly 300 having a conventional drill bit 302 mounted on the downstream end of a bent sub 304. A steerable motor 306 is disposed above the bent sub 304 and an eccentric adjustable blade stabilizer 308 is disposed above the steerable motor 306. A fixed pad 310 is mounted on the motor 306 at whatever height is desired for the bottom hole assembly 300. The blades 312 can then be adjusted on the eccentric adjustable blade stabilizer 308 to adjust the inclination of the bit 302 using the fixed pad 310 as a fulcrum. The eccentric adjustable blade stabilizer 308 is used to control the build angle. In this application the eccentric adjustable blade stabilizer of the present invention is used, not to maintain a bi-center bit on center, but to adjust the inclination of the bit for building drilling angle and thus inclination. By placing the eccentric adjustable blade stabilizer 308 above the motor 306, there is room to provide adequate stroke to properly incline the bit 302.

By having all three blades adjustable in multi-positions such as in the embodiment of FIGS. 47–48, the operator can control directional movement in three directions. This assembly would be a three dimensional rotary tool because the blades could be individually adjusted at any time. The radial movement of each of the blades is controlled independently. Further, this assembly (bi-centered bit and eccentric stabilizer) could be run in front of any three dimensional drilling tool, rotary or downhole motor driven, to drill an enlarged borehole.

Referring now to FIGS. 40–43, there is shown still another embodiment of a drilling assembly using the eccentric adjustable diameter blade stabilizer of the present invention. The bottom hole assembly 290 includes a standard drilling bit 272 with a winged reamer 292 mounted approximately 30 to 60 feet on drill collars 294 above bit 272. Eccentric adjustable diameter blade stabilizer 10 is mounted upstream of winged reamer 292. Stabilizer 10 acts as pivot or fulcrum for bit 272 and stabilizes the direction of the drilling of bit 272.

Another application includes placing a fixed blade on the steerable motor and an eccentric adjustable blade stabilizer above the motor. With the stabilizer blades in their contracted position, the drill string drills straight ahead. To build angle, rotation is stopped, the blades are pumped out of the eccentric adjustable blade stabilizer such that the blades push against the side of the borehole to provide a side load. This side load pushes the back side of the motor down causing the bit to pivot upwardly and build angle.

With this same assembly, the blades on the eccentric adjustable blade stabilizer can be adjustably extended to hold drilling angle. In other words with the blade on the eccentric adjustable blade stabilizer opposite to that of the fixed blade on the motor housing, they offset each other with respect to side loads to maintain hole angle. Both the eccentric blade stabilizer and the fixed blade would be rotating in the borehole. Although this application has been described as being used in the sliding mode, it can also be used in the rotating mode. Thus the upper eccentric adjustable blade stabilizer can be used in the rotating mode to offset the side load caused by the fixed blade on the motor housing and also assist in building angle by extending the blades of the eccentric adjustable blade stabilizer further in the radial position to add side load and thus help build angle.

A still another application of the present invention in a rotary assembly using a bi-center bit, the eccentric adjustable blade stabilizer replaces the concentric adjustable blade stabilizer and is disposed 10 or 15 feet above the bi-center bit. In this situation the eccentric adjustable blade stabilizer is used as a string stabilizer.

It should also be appreciated that the eccentric adjustable diameter blade stabilizer of the present invention may also be used to reenter an existing borehole for purposes of enlarging the borehole. In such a case, there is no pilot bit for centering the winged reamer. Therefore, the eccentric adjustable stabilizer 10 centers the bottom hole assembly within the borehole thereby allowing the winged reamer to ream and enlarge the existing borehole.

While a preferred embodiment of the invention has been shown and described, modifications thereof can be made by one skilled in the art without departing from the spirit of the invention.

What is claimed is:

1. A drilling assembly for a borehole having an axis comprising:

a bi-center bit having a pilot bit and an eccentric reamer section, said bi-center bit having a bi-center bit axis and said pilot bit having a pilot bit axis, said reamer section extending radially in a first direction from said bi-center bit axis;

an eccentric adjustable stabilizer mounted on said bi-center bit;

said stabilizer including a fixed blade extending radially in said first direction and at least one adjustable blade; and said adjustable blade having a first position centering said bi-center bit axis with said borehole axis and a second position centering said pilot bit axis with said borehole axis.

2. The drilling assembly of claim 1 for passing through an existing cased borehole and drilling a new borehole wherein:

said adjustable blade is contracted in said first position as the drilling assembly passes through the existing case borehole and is extended in said second position when drilling the new borehole; and said blades engaging the wall of said new borehole and centering said pilot bit within said new borehole.

3. The drilling assembly of claim 2 further including a second stabilizer mounted on a drill collar upstream of said eccentric stabilizer.

4. The drilling assembly of claim 3 wherein said second stabilizer is an adjustable concentric stabilizer with concentric adjustable blades mounted thereon and having multiple radial positions to incline said bi-center bit with said eccentric stabilizer acting as a fulcrum for said bi-center bit.

5. The drilling assembly of claim 3 wherein said second stabilizer includes an eccentric adjustable blade stabilizer.

6. The drilling assembly of claim 1 wherein said eccentric adjustable stabilizer is undergauge.

7. The drilling assembly of claim 1 wherein said eccentric adjustable stabilizer is disposed adjacent to said bi-center bit.

8. The drilling assembly of claim 5 wherein said eccentric adjustable blade stabilizers have fixed blades aligned with said reamer section.

9. A directional drilling assembly comprising:

a downhole drilling motor having an output shaft;

an eccentric adjustable blade stabilizer mounted on said output shaft;

a bi-center bit having a pilot bit and an eccentric reamer section extending radially in a first direction;

said stabilizer having a fixed blade extending radially in said first direction and two adjustable blades extending at an angle opposite to said first direction;

said adjustable blades having a contracted position for passing said drilling assembly through an existing case borehole and an extended position for maintaining the pilot bit on center.

10. The directional drilling assembly of claim 9 further including a second stabilizer disposed upstream of said drilling motor.

11. The directional drilling assembly of claim 10 wherein said second stabilizer is an adjustable concentric blade stabilizer with said blades having multi-positions, said concentric adjustable blades inclining said pilot bit with said eccentric stabilizer acting as a fulcrum.

12. A directional drilling assembly comprising:

a down hole motor having a housing with an output shaft extending therefrom;

a drilling bit mounted on said output shaft;

said housing having first adjustable blades extendable in a first direction from said housing;

a stabilizer disposed above said drilling motor and having second adjustable blades extendable in a direction opposite to said first direction;

said first and second adjustable blades being movable from a contracted position to an extended position;

said adjustable blades being in said contracted position for drilling in a straight direction and in said extended position for building drilling angle.

13. A drilling assembly comprising:

a down hole motor having an output shaft;

an eccentric adjustable diameter blade stabilizer mounted on said output shaft; and a bit mounted on said eccentric adjustable diameter blade stabilizer.

14. The drilling assembly of claim 13 wherein said eccentric adjustable diameter blade stabilizer includes a fixed blade extending radially in a first direction and at least one adjustable blade extending at an angle opposite to said first direction.

15. The drilling assembly of claim 13 wherein said eccentric adjustable diameter blade stabilizer includes adjustable blades having a contracted position and an extended position.

16. The drilling assembly of claim 15 wherein said adjustable blades have intermediate positions between said contracted position and said extended position.

17. The drilling assembly of claim 13 wherein said down hole motor includes a housing with a bend.

18. The drilling assembly of claim 13 further including a second stabilizer mounted above said down hole motor.

19. The drilling assembly of claim 13 wherein said bit is a bi-center bit.

20. The drilling assembly of claim 19 wherein said bi-center bit includes a reamer aligned with a fixed blade on said eccentric adjustable diameter blade stabilizer.

21. The method of claim 13 wherein the bit includes a reamer section aligned with a fixed blade on the eccentric adjustable blade stabilizer.

22. The method of claim 13 further comprising adjusting an adjustable concentric stabilizer above the down hole motor.

23. A method of drilling a borehole comprising:

lowering a bottom hole assembly including a down hole motor, an eccentric adjustable blade stabilizer mounted on an output shaft of the down hole motor and a bit mounted on the eccentric adjustable blade stabilizer;

moving adjustable blades on said eccentric adjustable blade stabilizer from a contracted position to an extended position;

rotating the bit and eccentric adjustable blade stabilizer with the down hole motor in a non-rotating position.

24. The method of claim 23 wherein said eccentric adjustable blade stabilizer includes adjustable blades and further includes adjusting the adjustable blades of the eccentric adjustable blade stabilizer radially to pivot the bit.

* * * * *